US007883084B2

(12) United States Patent
Okumura et al.

(10) Patent No.: US 7,883,084 B2
(45) **Date of Patent: *Feb. 8, 2011**

(54) SHEET FEEDING DEVICE AND IMAGE FORMING APPARATUS WITH WARM AIR UNIT FOR BLOWING AIR TOWARD UPPER FACE OF SHEET STACK

(75) Inventors: Keiji Okumura, Osaka (JP); Yoshihiro Yamaguchi, Osaka (JP); Yoshio Sugishima, Osaka (JP); Sachio Izumichi, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/490,576

(22) Filed: Jun. 24, 2009

(65) Prior Publication Data

US 2010/0001454 A1 Jan. 7, 2010

(30) Foreign Application Priority Data

Jul. 1, 2008 (JP) ..... 2008-172523
Jul. 29, 2008 (JP) ..... 2008-194723

(51) Int. Cl.
*B65H 3/46* (2006.01)

(52) U.S. Cl. ..... 271/105; 271/90; 271/97

(58) Field of Classification Search ..... 271/97, 271/98, 11, 105

See application file for complete search history.

(56) References Cited

U.S. PATENT DOCUMENTS

| | | | | |
|---|---|---|---|---|
| 4,925,177 | A * | 5/1990 | Nakamura et al. | 271/110 |
| 7,451,973 | B2 | 11/2008 | Koga et al. | |
| 2008/0247774 | A1 * | 10/2008 | Koga | 399/97 |
| 2009/0236794 | A1 * | 9/2009 | Tsukamoto et al. | 271/11 |

FOREIGN PATENT DOCUMENTS

| | | | |
|---|---|---|---|
| JP | 58062664 | A * | 4/1983 |
| JP | 04094337 | A * | 3/1992 |
| JP | 06083221 | A * | 3/1994 |
| JP | 7-12359 | | 3/1995 |
| JP | 2001-48366 | | 2/2002 |
| JP | 2003-150024 | | 5/2003 |
| JP | 2006-264917 | | 10/2006 |
| JP | 2007-308284 | | 11/2007 |

* cited by examiner

*Primary Examiner*—Stefanos Karmis
*Assistant Examiner*—Gerald W McClain
(74) *Attorney, Agent, or Firm*—Gerald E. Hespos; Michael J. Porco

(57) ABSTRACT

A sheet feeding device for feeding a sheet-form recording medium includes: a sheet accommodating portion for accommodating a sheet stack constituted by a plurality of sheets of the sheet-form recording medium; and a first warm air unit having a first blowing port for blowing warm air toward an upper face of the sheet stack accommodated in the sheet accommodating portion. The sheet feeding device preferably further includes a second warm air unit having a second blowing port for blowing warm air onto a side face of the sheet stack that is parallel to a sheet feeding direction.

17 Claims, 23 Drawing Sheets

SHEET FEEDING DEVICE AND IMAGE FORMING APPARATUS WITH WARM AIR UNIT FOR BLOWING AIR TOWARD UPPER FACE OF SHEET STACK

BACKGROUND OF THE INVENTION

This application is based on Japanese Patent Application Serial No. 2008-172523 and 2008-194723, filed in Japan Patent Office on Jul. 1, 2008 and Jul. 29, 2008 respectively, the contents of which are hereby incorporated by reference.

1. Field of the Invention

The present invention relates to a sheet feeding device having a sheet loosening mechanism that employs warm air assistance, and an image forming apparatus including the sheet feeding device.

2. Description of the Related Art

In a conventional image forming apparatus such as a printer, a copier, or a facsimile, cut sheets of high quality paper, regular paper specified by a copier manufacturer, and so on are typically used as a sheet-form recording medium fed continuously into an image formation unit. A cut sheet of high quality paper, regular paper, and so on has low surface smoothness, and therefore a sheet sticking force thereof is comparatively low. It is therefore comparatively easy to prevent multi-feeding, in which a plurality of cut sheets are supplied while stuck together, when dispatching the cut sheets one at a time from a sheet carrying unit such as a sheet feeding tray. Furthermore, even when multi-feeding occurs during use of the cut sheets, the cut sheets can be dispatched one at a time comparatively favorably by providing a separating roller, a separating pad, a separating pawl, or similar.

In recent years, however, diversification of sheet-form recording media has progressed to the point where not only sheets of high quality paper, regular paper, and so on having low surface smoothness are used. In particular, as colorization techniques become more advanced in image forming apparatuses, the use of recording media having high surface smoothness, such as enhanced-whiteness gloss enamel paper (composite paper coated on one or both sides with a coating color, which is a type of paint, with the aim of improving printing suitability), is becoming more widespread. In other words, not only high quality paper and regular paper, but also the enamel paper described above as well as film sheets, tracing paper, and so on are used in the same machine type. Enamel paper, film sheets, tracing paper, and so on exhibit a strong inter-sheet sticking force, and it is therefore difficult to prevent multi-feeding of the sheets. Hence, special measures must be taken in relation to sheet feeding (sheet dispatch).

Furthermore, an upper face and a peripheral part of a stack of sheets disposed on the sheet carrying unit are exposed to outside air, and are therefore likely to contain a large amount of moisture. In other words, the upper face and side faces of the sheet stack swell due to moisture absorption, whereas the degree of swelling on the inside of the sheet stack is lower than that of the upper face and side faces due to the smaller amount of moisture. As a result, pressure inside (in the inter-sheet spaces of) the sheet stack may turn negative such that the sheets stick together.

To loosen the sheet stack by separating sheets that are stuck together prior to sheet feeding, large copiers and so on employ a sheet feeding device having a mechanism (to be referred to hereafter as a "lateral warm air assistance") for blowing warm air onto the side face of the sheet stack.

For example, Japanese Unexamined Patent Application Publication No. 2001-48366 discloses a technique for improving sheet drying efficiency in a sheet loosening method employing lateral warm air assistance by appropriately adjusting the humidity of lateral warm air that is blown onto the side face of a sheet stack.

However, in the conventional sheet loosening technique employing lateral warm air assistance described above, it is difficult for the warm air to reach regions remote from a warm air blowing port, and it is therefore difficult to loosen the sheets by introducing warm air into the vicinity of the outer periphery of the sheets, in which the sticking force is particularly strong. In other words, when lateral warm air assistance is used conventionally, required warm air blowing means, heating means, a power supply, and soon must all be large to obtain a favorable loosening effect. Therefore, conventional sheet loosening techniques employing lateral warm air assistance are limited to application to comparatively large sheet feeding decks accommodating between approximately 2000 and 4000 sheets.

SUMMARY OF THE INVENTION

An object of the present invention is to provide a sheet feeding device that can be disposed in a small space and includes a sheet loosening mechanism employing warm air assistance, and an image forming apparatus having the sheet feeding device.

A sheet feeding device according to one aspect of the present invention for achieving this object is a sheet feeding device for feeding a sheet-form recording medium, including a sheet accommodating portion for accommodating a sheet stack constituted by a plurality of sheets of the sheet-form recording medium, and a first warm air unit having a first blowing port for blowing warm air toward an upper face of the sheet stack accommodated in the sheet accommodating portion.

Further, an image forming apparatus according to another aspect of the present invention includes a sheet feeding device for feeding a sheet-form recording medium, and an apparatus main body including an image formation unit for forming an image on the sheet-form recording medium fed from the sheet feeding device, wherein the sheet feeding device is constituted as described above.

DETAILED DESCRIPTION OF THE PREFERRED EMBODIMENTS

Several embodiments of the present invention will be described in detail below on the basis of the drawings. It is assumed that in each of the drawings, members and so on having identical reference symbols are constituted identically, and therefore duplicate description of these members and so on has been omitted where appropriate. Furthermore, members and so on that do not need to be described have been omitted from the drawings where appropriate.

First Embodiment

Figure 1:
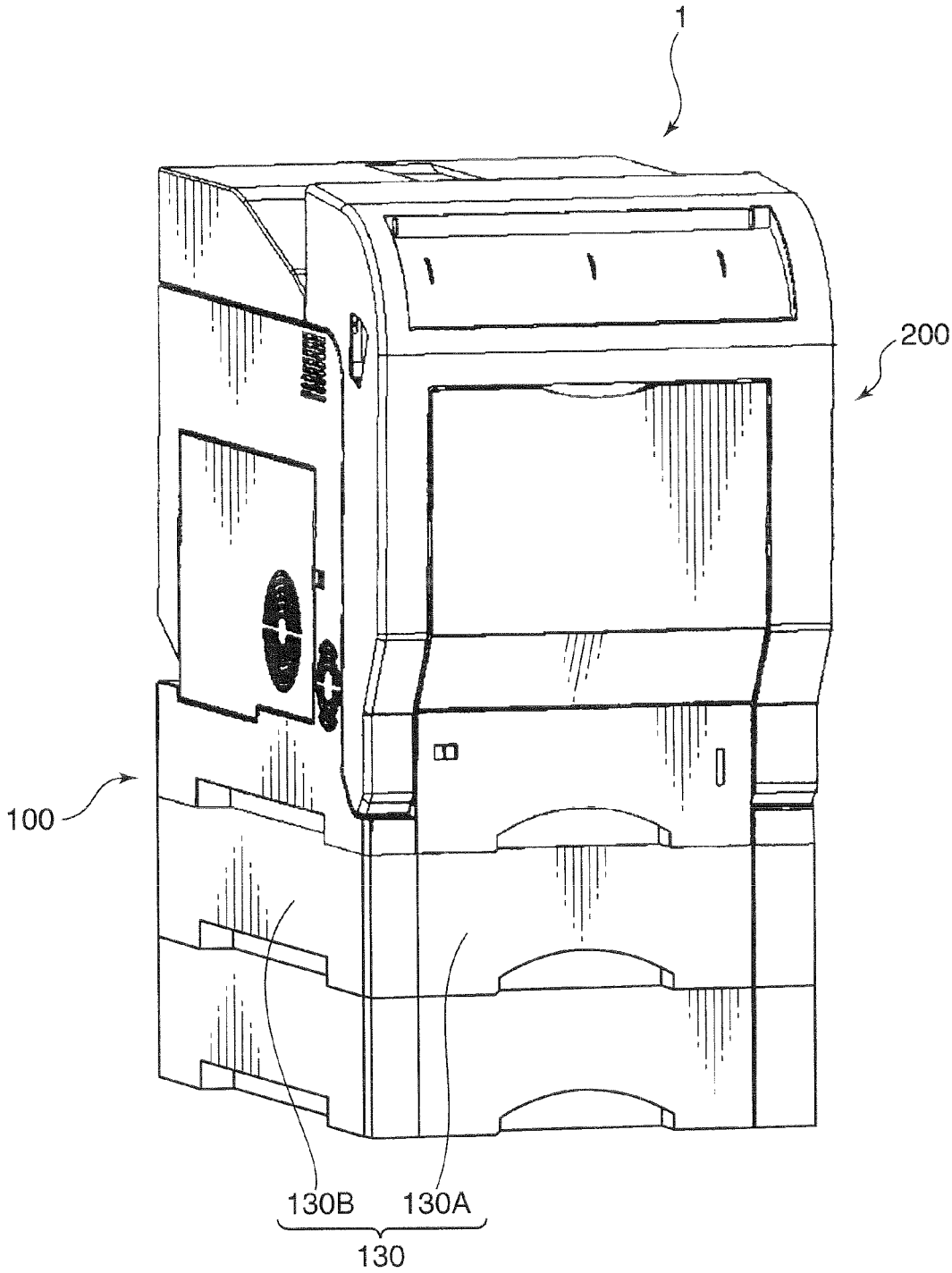
FIG. 1 is a perspective view showing the outer form of a printer including a sheet feeding device according to an embodiment of the present invention.

First, referring to FIG. 1 and FIG. 2, an image forming apparatus including a sheet feeding device according to an embodiment of the present invention will be described. FIG. 1 is a perspective view showing the outer form of an image forming apparatus (a color printer 1) including a sheet feeding device (a sheet feeding unit 130) according to a first embodiment, and FIG. 2 is a sectional view showing the internal structure of the image forming apparatus.

As shown in FIG. 1, the color printer 1 includes a printer main body 200 connected to a personal computer (PC) (not shown) or the like directly or via a LAN, and a sheet supply unit 100 provided beneath the printer main body 200 and constituted to be capable of storing sheets P of various sizes in accordance with their size. Note that the color printer 1 also includes other constitutional elements typically provided in a color printer, such as a control circuit for controlling operations of the color printer 1.

Figure 2:
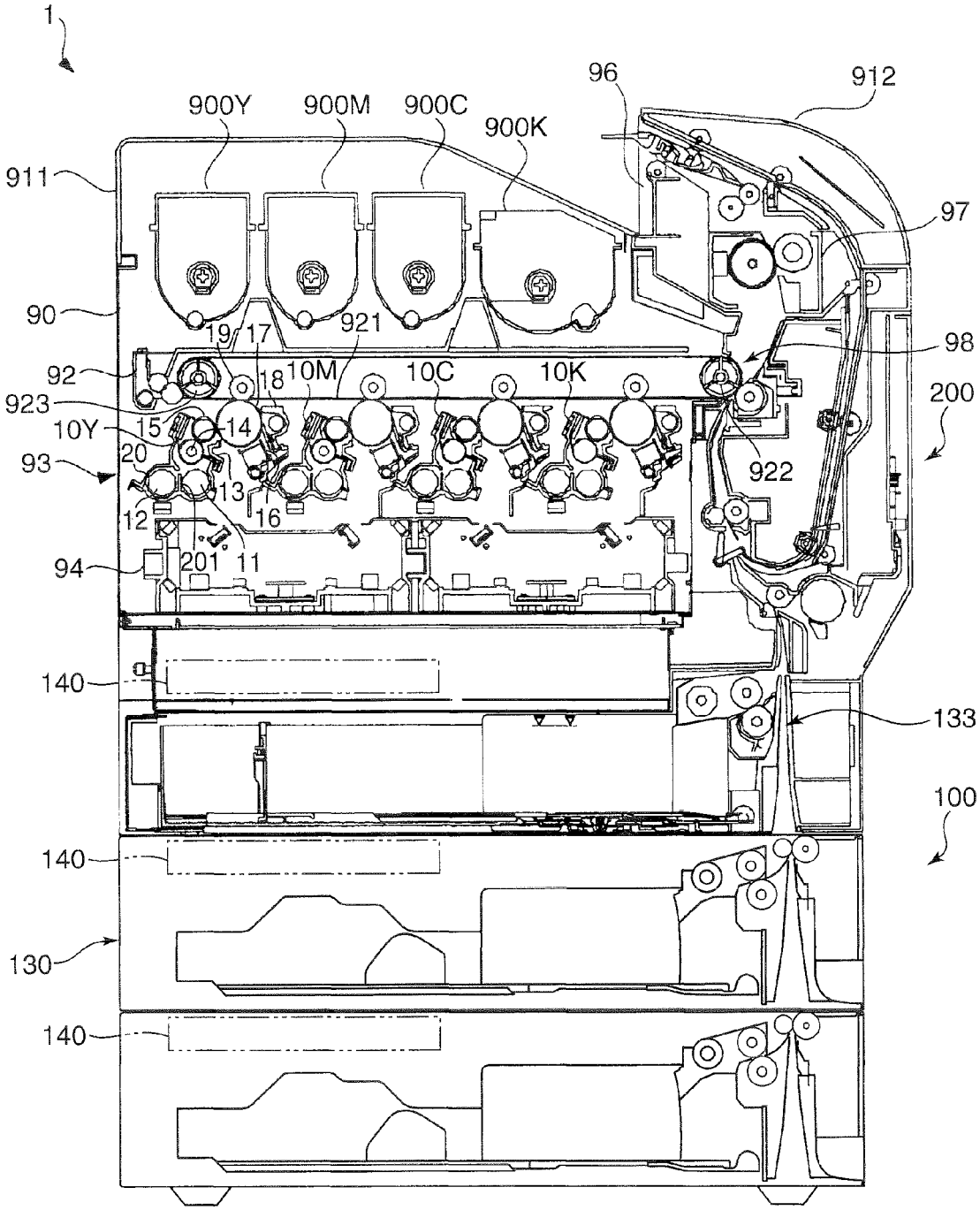
FIG. 2 is a sectional view showing the internal constitution of the printer shown in FIG. 1.

As shown in FIG. 2, the printer main body 200 includes toner containers 900Y, 900M, 900C, 900K, an intermediate transfer unit 92, an image formation unit 93, an exposure unit 94, the sheet supply unit 100, a fixing unit 97, a sheet discharge unit 96, an apparatus main body casing 90, a top cover 911, and a front cover 912.

The image formation unit 93 includes a yellow toner container 900Y, a magenta toner container 900M, a cyan toner container 900C, a black toner container 900K, and developing devices 10Y, 10M, 10C, 10K disposed therebelow in accordance with the respective colors YMCK.

Further, photosensitive drums 17 (photosensitive bodies on which latent images are formed by an electrophotographic method) for carrying toner images in the respective colors are provided in the image formation unit 93. A photosensitive drum using an amorphous silicon (a-Si)-based material may be employed as the photosensitive drum 17. Yellow, magenta, cyan, and black toner is supplied to the respective photosensitive drums 17 from the corresponding toner container 900Y, 900M, 900C, 900K. The image formation unit 93 described above is capable of forming a full color image, but the image formation unit is not limited thereto, and may be constituted to form monochrome images or color images that are not full color.

A charger 16, the developing devices 10 (10Y, 10M, 10C, 10K), a transfer device (transfer roller) 19, a cleaning device 18, and so on are disposed around the photosensitive drum 17. The charger 16 charges the surface of the photosensitive drum 17 uniformly. After being charged, the surface of the photosensitive drum 17 is exposed by the exposure unit 94 such that an electrostatic latent image is formed thereon. The developing devices 10Y, 10M, 10C, 10K use the colored toner supplied by the respective toner containers 900Y, 900M, 900C, 900K to develop (make visible) the electrostatic latent images formed on the respective photosensitive drums 17. The transfer roller 19 forms a nip portion by pressing the intermediate transfer belt 921 against the photosensitive drum 17 and thereby subjects the toner image formed on the photosensitive drum 17 to primary transfer onto the intermediate transfer belt 921. The cleaning device 18 cleans the peripheral surface of the photosensitive drum 17 following toner image transfer.

Each developing devices 10Y, 10M, 10C, 10K includes the casing 20, and a two-component developer constituted by a magnetic carrier and a toner is stored in the interior of the casing 20. Further, two agitating rollers 11, 12 (developer agitating members) are disposed rotatably in the vicinity of a bottom portion of the casing 20 in parallel, taking a lengthwise direction as their axial direction.

A developer circulation route is set on the interior bottom surface of the casing 20, and the agitating rollers 11, 12 are disposed on the circulation route. A partition wall 201 standing upright from the casing bottom portion is provided in the axial direction between the agitating rollers 11, 12. The partition wall 201 defines the circulation route, and the circulation route is formed to travel around the periphery of the partition wall 201. The two-component developer is charged while being agitated by the agitating rollers 11 and 12 so as to travel along the circulation route.

The two-component developer circulates through the casing 20 while being agitated by the agitating rollers 11 and 12, whereby the toner is charged and the two-component developer on the agitating roller 11 is aspirated onto and conveyed by a magnetic roller 14 positioned on an upper side thereof. The aspirated two-component developer forms a magnetic brush (not shown) on the magnetic roller 14. A layer thickness of the magnetic brush is limited by a doctor blade 13. A toner layer is formed on a developing roller 15 by a potential difference between the magnetic roller 14 and the developing roller 15, and the electrostatic latent image on the photosensitive drum 17 is developed by the toner layer.

The exposure unit 94 includes various optical devices such as a light source, a polygon mirror, a reflection mirror, and a deflection mirror, and irradiates the peripheral surface of the photosensitive drum 17 provided in each of the image formation units 93 with light based on image data to form the electrostatic latent image.

The intermediate transfer unit 92 includes the intermediate transfer belt 921, a drive roller 922, and a driven roller 923. The intermediate transfer belt 921 performs a primary transfer on superimposed toner images applied thereto from the plurality of photosensitive drums 17, and then subjects the toner image to a secondary transfer onto a sheet P supplied by the sheet feeding unit 130 at a secondary transfer portion 98. The drive roller 922 and driven roller 923 drive the intermediate transfer belt 921 to revolve. The drive roller 922 and driven roller 923 are supported by a casing, not shown in the drawings, to be free to rotate.

The fixing unit 97 implements fixing processing on the toner image subjected to the secondary transfer onto the sheet P from the intermediate transfer unit 92. Following completion of the fixing processing, the sheet P including a color image is discharged toward the discharge unit 96 formed on an upper portion of the apparatus main body 200.

The sheet discharge unit 96 discharges the sheet P conveyed thereto from the fixing unit 97 onto the top cover 911, which serves as a sheet discharge tray.

The sheet supply unit 100 includes a plurality of (three in this embodiment) sheet feeding units 130 (sheet feeding devices) attached detachably to the printer main body 200 in tiers. Each sheet feeding unit 130 accommodates a sheet stack S constituted by a plurality of sheets P to be subjected to image formation, and is attached detachably to the casing 90. Sheet stacks S in each of the aforementioned sizes are stored in the respective sheet feeding units 130. In a selected sheet feeding unit 130 during an image formation operation, sheets P on the uppermost layer of the sheet stack S are extracted one at a time by driving a pickup roller 40 provided in the sheet feeding unit 130, dispatched onto a sheet feeding conveyance path 133, and introduced into the image formation unit 93.

Each sheet feeding unit 130 includes a conveyance mechanism, a plurality of which can be attached to a lower portion of the printer main body 200 subsequently in a stacked plurality, and thus, a desired number of the sheet feeding units 130 can be attached subsequently to the printer main body 200 at any time. In other words, by stacking a plurality of the sheet feeding units 130 in the lower portion of the printer main body 200, the conveyance mechanisms provided in the respective sheet feeding units 130 are coupled to each other to form the single sheet feeding conveyance path 133 extending to the printer main body 200. Hence, the sheet feeding units 130 can be attached subsequently in a plurality of stacked tiers.

Note that in this embodiment, an example in which the sheet supply unit 100 is constituted by three sheet feeding units 130 is described, but the present invention is not limited thereto, and may be applied similarly to an image forming apparatus such as a printer having one, two, four, or more sheet feeding units 130.

Next, referring to FIG. 1 and FIGS. 3 to 9, the constitution of the sheet feeding unit 130 will be described in detail. As shown in FIG. 1, the sheet feeding unit 130 is constituted by a sheet feeding cassette 130A and a sheet feeding unit main body 130B. The sheet feeding cassette 130A slides forward and backward relative to the sheet feeding unit main body 130B. A typical sliding mechanism (a drawer mechanism) may be employed in the sheet feeding cassette 130A and the sheet feeding unit main body 130B.

Figure 3:
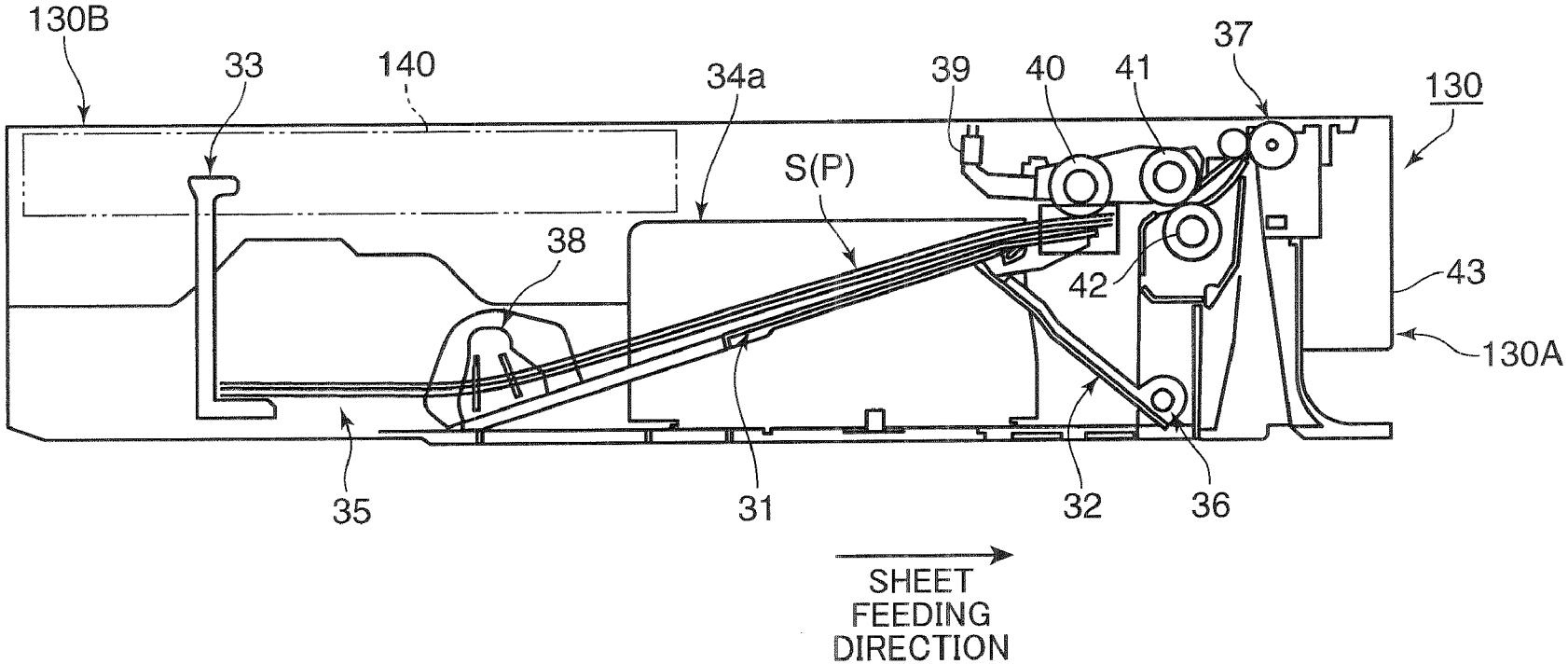
FIG. 3 is a sectional view showing the constitution of a sheet feeding device according to a first embodiment of the present invention.
Figure 4:
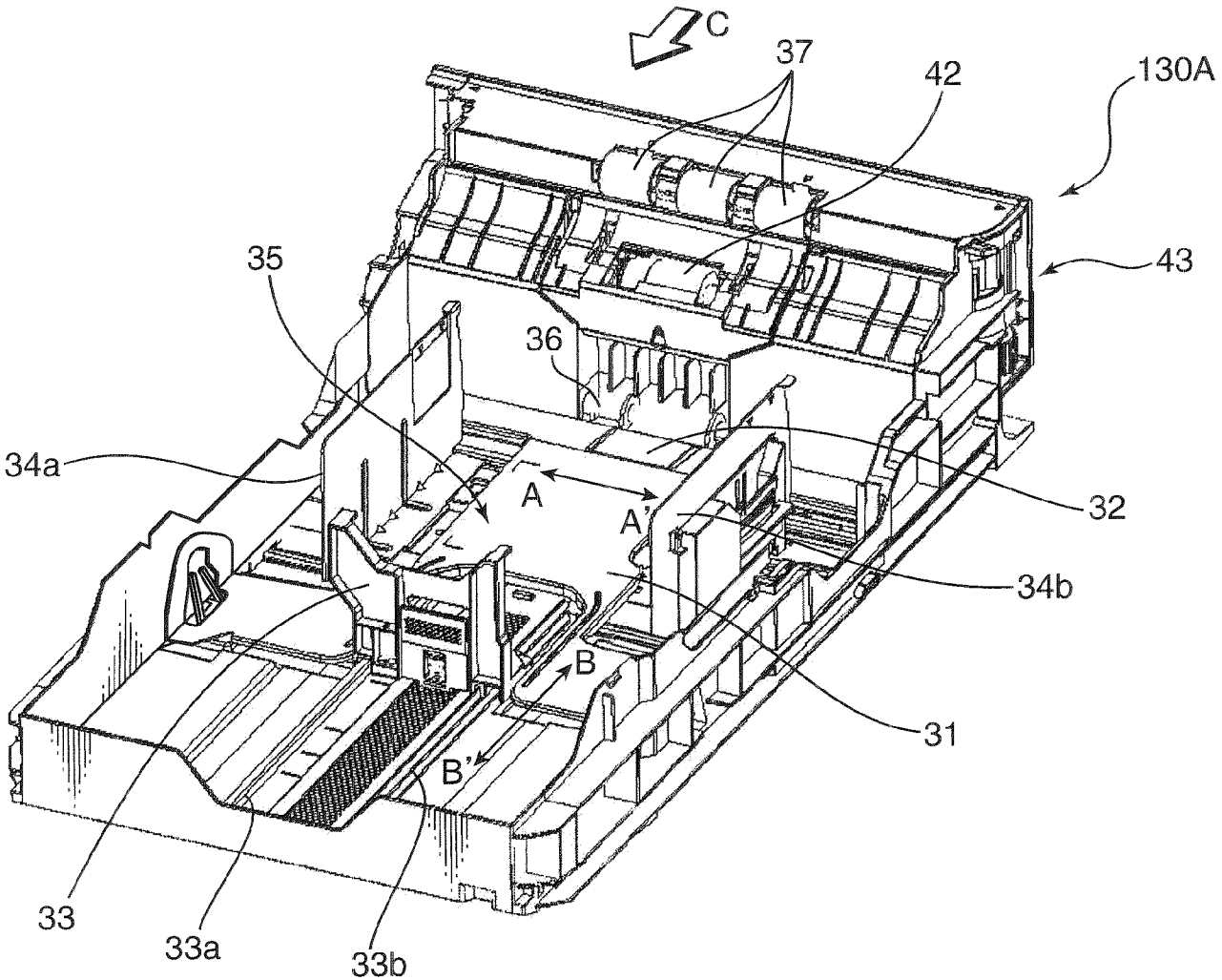
FIG. 4 is a perspective view showing a state in which a sheet feeding cassette of the sheet feeding device shown in FIG. 3 is withdrawn from a sheet feeding device main body.
Figure 5B:
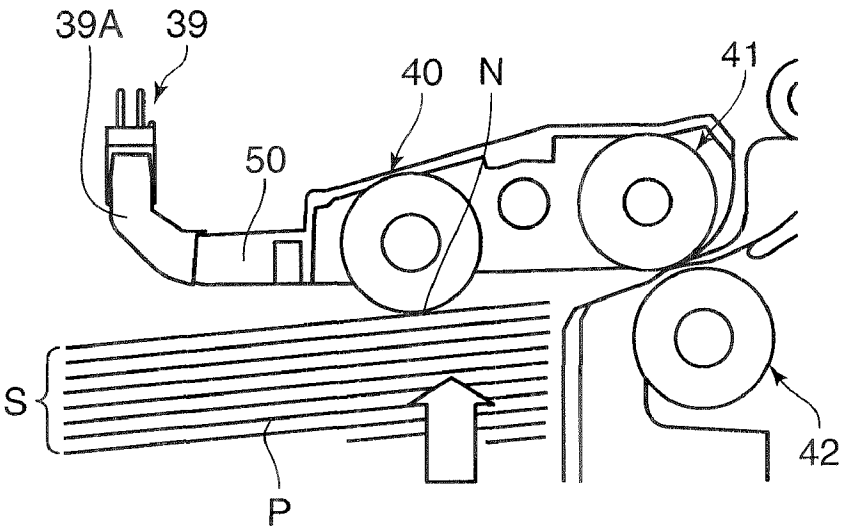
FIGS. 5A and 5B are illustrative views showing a position detection sensor installed in the sheet feeding device.
Figure 5A:
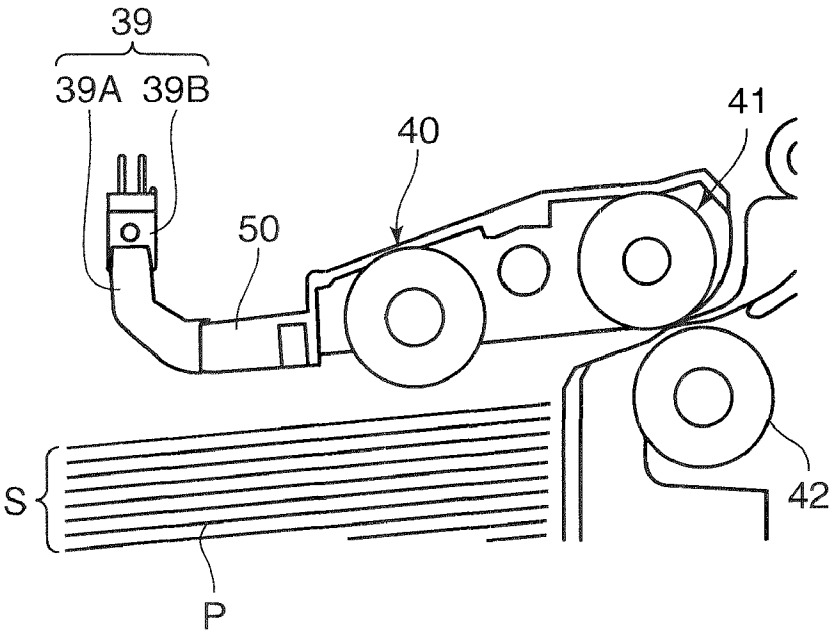
Figure 6:
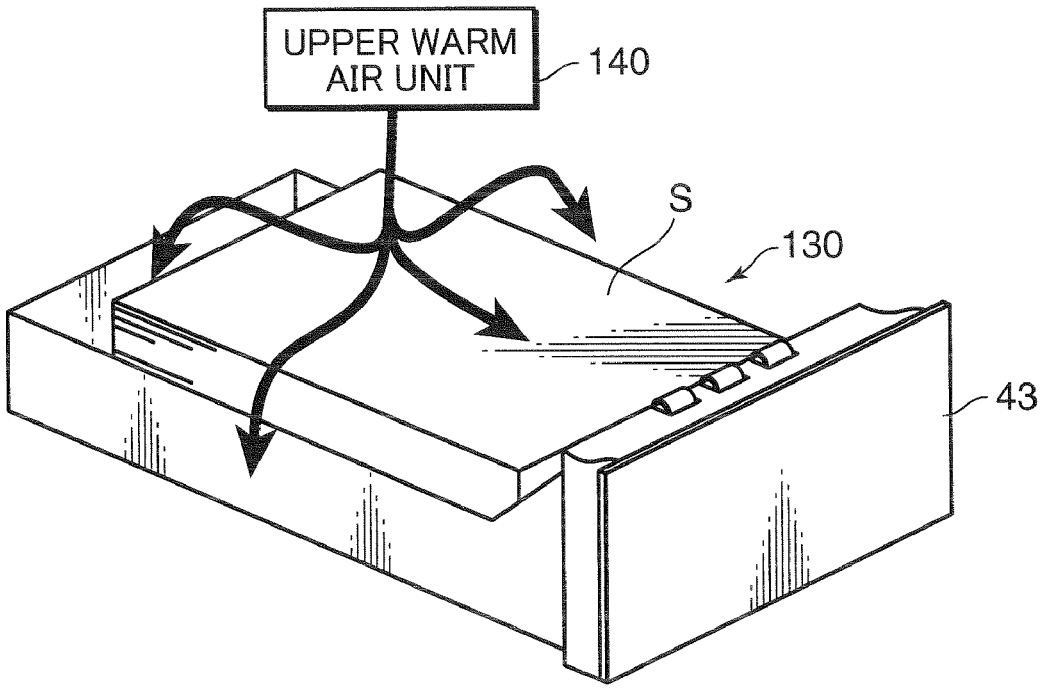
FIG. 6 is a perspective view illustrating a warm air blowing direction of an upper warm air unit installed in the sheet feeding device.
Figure 7:
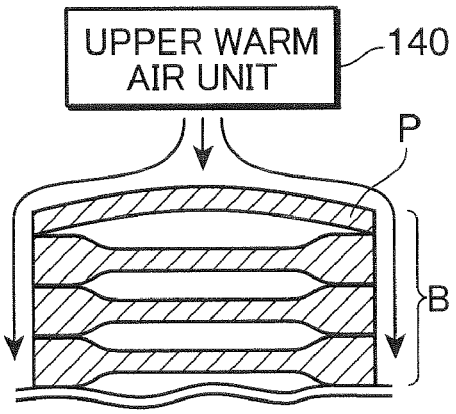
FIG. 7 is a schematic diagram showing the warm air blowing direction of the upper warm air unit.
Figure 8:
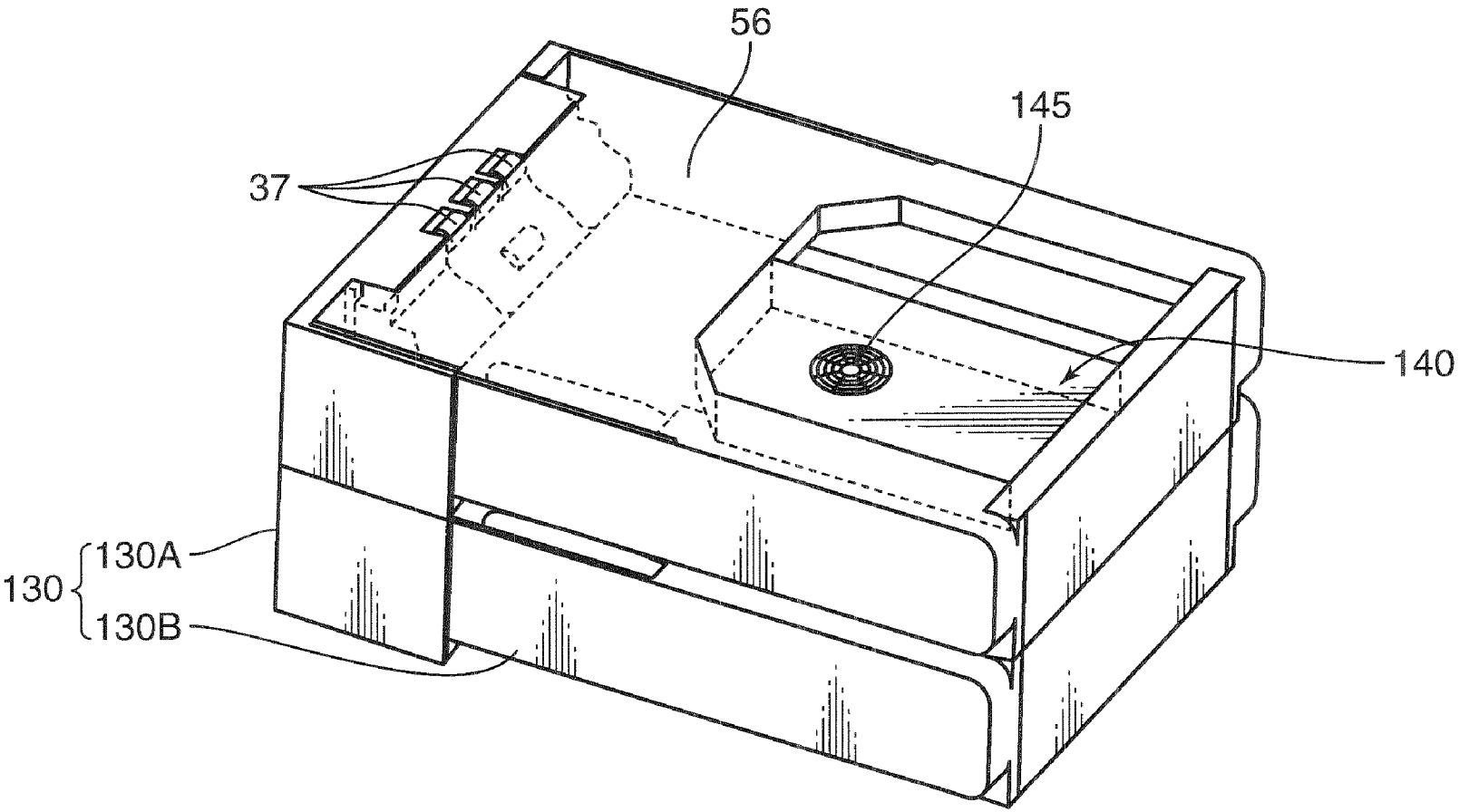
FIG. 8 is a perspective view of the sheet feeding device, illustrating an installation position of the upper warm air unit.
Figure 9:
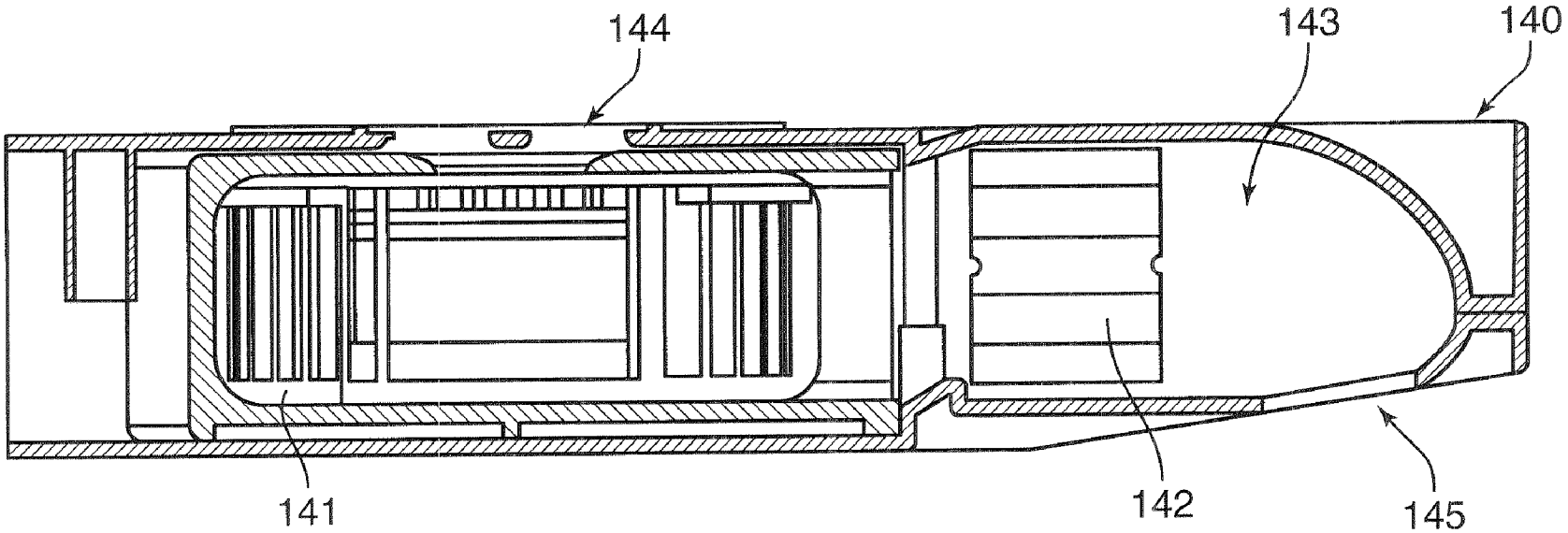
FIG. 9 is a vertical direction sectional view showing the constitution of the main parts of the upper warm air unit.

FIG. 3 is a sectional view of the sheet feeding unit 130. FIG. 4 is a perspective view showing a state in which the sheet feeding cassette 130A is withdrawn from the sheet feeding unit main body 130B. FIGS. 5A and 5B are views showing a position detection sensor 39 installed in the sheet feeding unit 130. FIG. 6 is a perspective view illustrating a warm air blowing direction of an upper warm air unit 140 (first warm air unit) installed in the sheet feeding unit 130. FIG. 7 is a schematic diagram showing the warm air blowing direction of the upper warm air unit 140. FIG. 8 is a perspective view of the sheet feeding unit 130, illustrating an installation position of the upper warm air unit 140. FIG. 9 is a vertical direction sectional view showing the constitution of the main parts of the upper warm air unit 140.

As shown in FIGS. 3 and 4, a lift plate 31 (sheet carrying plate) for carrying the sheet stack S constituted by a plurality of the sheets P (the sheet-form recording medium) is provided on an inner bottom surface of a sheet accommodating portion 35 of the sheet feeding unit 130. A sheet feeding direction upstream side end (a left side end portion in FIG. 3) of the lift plate 31 is supported rotatably by a support portion 38. In other words, the lift plate 31 can be rotated by the support portion 38 in a vertical plane in the interior of the sheet accommodating portion 35 using a downstream end thereof as a free end. The support portion 38 is provided on wall portions on either side of the sheet accommodating portion 35, which is disposed to face a width direction of the sheet P (an orthogonal direction to the sheet feeding direction).

The sheet feeding cassette 130A of the sheet feeding unit 130 includes a pair of width alignment cursors 34*a*, 34*b* for positioning the sheets P accommodated in the sheet accommodating portion 35 in the width direction, and a rear end cursor 33 for aligning a rear end of the sheets P. The pair of width alignment cursors 34*a*, 34*b* are provided to be capable of performing a reciprocating motion in the sheet width direction (a direction indicated by an arrow AA' in FIG. 4) along respective guide rails, not shown in the drawings. Here, the sheet P is dispatched in a direction indicated by an arrow B in FIG. 4, and therefore the rear end cursor 33 is provided to be capable of performing a reciprocating motion parallel to the sheet conveyance direction (a direction indicated by an arrow BB' in FIG. 4) along guide rails 33*a*, 33*b*. The sheet stack S is accommodated in a predetermined position of the sheet feeding unit 130 once the width alignment cursors 34*a*, 34*b* and the rear end cursor 33 have been moved in accordance with the size of the carried sheets. The sheet feeding unit 130 includes a cassette cover 43, a front surface side (a side seen from a direction indicated by an arrow C in FIG. 4) of which is exposed to the outside to form a part of an outer covering surface of the color printer 1.

A drive shaft 36, a push-up member 32, and a driving connecting member (not shown) are provided below a sheet feeding direction downstream portion of the lift plate 31 as an elevator mechanism for raising and lowering the lift plate 31. Further, a receiving member (not shown) corresponding to the driving connecting member and a motor (not shown) that is connected to the receiving member and capable of normal and reverse rotation are provided on the sheet feeding unit main body 130B side. When the sheet feeding cassette 130A is accommodated in the sheet feeding unit main body 130B, the driving connecting member of the sheet accommodating portion 35 on the sheet feeding cassette 130A side engages connectedly with the receiving member on the sheet feeding unit main body 130B side. Thus, the power of the motor can be transmitted to the drive shaft 36. The elevator mechanism, which displaces the lift plate 31 between a sheet feeding position (first position) and a withdrawn position (second position) withdrawn from the sheet feeding position, is constituted by the drive shaft 36, the push-up member 32, the driving connecting member, the receiving member, and the motor. In the sheet feeding position, the lift plate 31 is raised such that an upper face of the sheet stack S carried on the lift plate 31 contacts the pickup roller 40, enabling sheet feeding. In the withdrawn position according to this embodiment, the lift plate 31 is lowered to a lower limit.

Further, as shown in FIG. 3, the sheet feeding unit 130 includes a sheet feeding roller 41 provided on a conveyance direction downstream side of the pickup roller 40, and a loosening roller 42 provided below the sheet feeding roller 41. Further, a conveyance roller 37 is provided on the conveyance direction downstream side of the pickup roller 40 and the sheet feeding roller 41. The sheet feeding roller 41 is provided on the sheet feeding unit main body 130B side together with the pickup roller 40, whereas the loosening roller 42 and the conveyance roller 37 are provided on the sheet feeding cassette 130A side. When the sheet feeding cassette 130A is attached to the sheet feeding unit main body 130B, the sheet feeding roller 41 contacts the loosening roller 42.

The sheet feeding roller 41 feeds a sheet P extracted from the sheet stack S by the pickup roller 40 to the conveyance roller 37. The sheet feeding roller 41 rotates in a direction for conveying the sheet P downstream, whereas the loosening roller 42 rotates in an opposite direction for returning the sheet P upstream. In a case where a plurality of overlapped sheets P is extracted by the pickup roller 40, the loosening roller 42 can be used to prevent all but the uppermost sheet P from being fed in the direction of the conveyance roller 37, and thus only the uppermost sheet P is conveyed to the conveyance roller 37 by the sheet feeding roller 41. The conveyance roller 37 conveys the sheet P onto the sheet feeding conveyance path 133 (see FIG. 2).

Further, as shown in FIGS. 5A and 5B, the sheet feeding unit 130 includes the position detection sensor 39 for detecting that the uppermost sheet P of the sheet stack S carried on the lift plate 31 is in the sheet feeding position. The position detection sensor 39 is constituted by a light blocking member 39A and an optical sensor 39B. The optical sensor 39B is constituted by a light emitting element provided fixedly in the vicinity of the pickup roller 40, and a light receiving element for receiving light emitted by the light emitting element. The light blocking member 39A is provided on a support member 50 of the pickup roller 40. Further, the support member 50 is provided to be capable of rotating about a rotary axis of the sheet feeding roller 41.

Hence, when the lift plate 31 is raised such that the upper face of the sheet stack S carried on the lift plate 31 moves into the sheet feeding position shown in FIG. 5B, the pickup roller 40 is pushed up by the uppermost sheet P so as to rotate about the rotary axis of the sheet feeding roller 41 and thereby displace slightly upward. At this time, the light blocking member 39A is lifted up in conjunction with the pickup roller 40, thereby blocking an optical path of the optical sensor 39B, and accordingly, it is possible to detect that the upper face of the sheet stack S is in the sheet feeding position.

When the motor is activated in the sheet feeding unit 130 constituted as described above, the push-up member 32 pushes up the downstream end side of the lift plate 31 while remaining engaged with the bottom surface of the lift plate 31. As a result, the upper face of the sheet stack S carried on the lift plate 31 displaces to the sheet feeding position contacting the pickup roller 40 provided above the sheet feeding cassette 130A.

At this time, driving of the motor is stopped when the position detection sensor 39 detects displacement of the pickup roller 40 to the sheet feeding position, as shown in FIG. 5B. Further, when the position detection sensor 39 no longer detects this displacement due to a reduction in the number of sheets P during sheet feeding, the motor is activated to lift the sheet stack S up to the sheet feeding position.

Note that in this embodiment, a detected portion (the light blocking member 39A) is provided on the support member 50 of the pickup roller 40, but the present invention is not limited thereto, and the upper face of the sheet stack S may be detected directly in the vicinity of the pickup roller 40 or using a detection mechanism other than an optical sensor, for example.

As shown in FIG. 2, FIG. 3, and FIGS. 6 to 9, the sheet feeding unit 130 according to this embodiment includes an upper warm air unit 140 serving as a sheet loosening mechanism employing warm air (warm air assistance). The upper warm air unit 140 is provided on the sheet feeding unit main body 130B side. As shown in FIG. 8, a ceiling plate 56 is provided over an upper face of the sheet feeding unit main body 130B such that an upper portion of a sheet accommodating space is sealed by the ceiling plate 56. An opening portion is provided in the ceiling plate 56, and the upper warm air unit 140 is attached to the opening portion.

As shown in FIG. 9, the upper warm air unit 140 includes an intake port 144 for taking in air, a warm air blowing port 145 (first blowing port) provided above the upper face of the sheet stack S provided in the sheet accommodating portion 35, and an upper warm air chamber 143 serving as a warm air passage space. Warm air is blown toward the upper face of the sheet stack S accommodated in the sheet accommodating portion 35 through the warm air blowing port 145.

Further, a fan 141 (first blowing portion) and a heater 142 (first heating portion) are provided in the upper warm air chamber 143 of the upper warm air unit 140. The intake port 144 is provided in an upper face of the upper warm air chamber 143 above the fan 141. Hence, when the fan 141 rotates, air in the upper warm air chamber 143 moves to the heater 142 side and outside air is taken into the upper warm air chamber 143 through the intake port 144. The air that moves to the heater 142 side is heated by the heater 142 and blown toward the upper face of the sheet stack S through the warm air blowing port 145 provided in a lower face of the upper warm air chamber 143. The warm air blowing port 145 is formed in the upper warm air unit 140 on a downstream side of the sheet feeding direction when the upper warm air unit 140 is attached to the sheet feeding unit 130.

Figure 10:
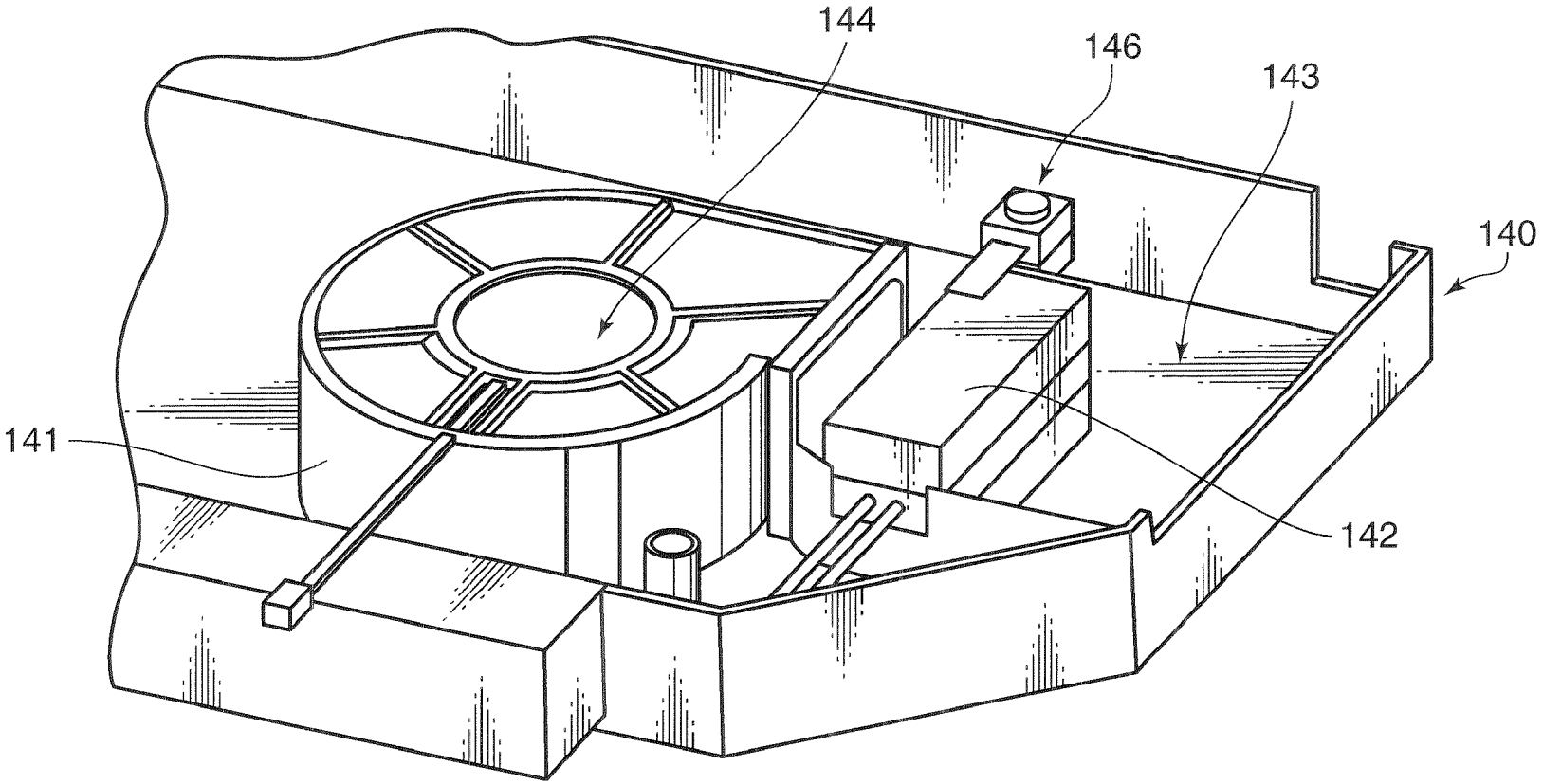
FIG. 10 is a perspective view of the upper warm air unit.

FIG. 10 is a perspective view of the upper warm air unit 140. As shown in FIG. 10, a first temperature sensor 146 (first temperature detection unit) is attached to an upper face of the heater 142. A typical temperature sensor such as a resistance temperature sensor constituted by a thermistor may be used as the first temperature sensor 146.

When a predetermined sheet feeding unit 130 is selected during an image formation operation in the constitution described above, the lift plate 31 is driven to rise, whereby the sheet stack S is raised in the direction of the pickup roller 40, and the upper warm air unit 140 is driven to blow warm air toward the upper face of the sheet stack S through the warm air blowing port 145.

As shown in FIG. 7, the upper face and peripheral part of the sheet stack S are exposed to outside air and are therefore likely to contain a lot of moisture. In other words, the upper face and side faces of the sheet stack S swell due to moisture absorption, whereas the degree of swelling on the inside of the sheet stack S is lower than that of the upper face and side faces due to the smaller amount of moisture. As a result, a phenomenon occurs whereby pressure on the inside (in the inter-sheet spaces) of the sheet stack S turns negative such that the sheets stick together.

However, according to the sheet feeding unit 130 of this embodiment, a relative humidity of the sheet stack S in the sheet feeding unit 130 (the humidity of the upper face and outer peripheral part of the sheet stack S relative to the other parts) can be reduced instantaneously by providing the upper warm air unit 140.

More specifically, as shown in FIGS. 6 and 7, the upper warm air unit 140 is capable of blowing warm air evenly and in concentrated fashion from the upper face of the sheet stack S, in which sticking is particularly likely to occur, to the vicinity of the outer periphery. As a result, a moisture absorption rate of the upper face and outer peripheral part of the sheet stack S is reduced rapidly, thereby eliminating swelling in these parts. Hence, the relative humidity of the sheet stack S can be reduced instantly, and negative pressure inside (in the inter-sheet spaces of) the sheet stack S can also be eliminated. Thus, a reduction in sheet sticking force can be achieved, and as a result, the sheet stack S can be loosened efficiently prior to sheet feeding.

Further, as shown in FIG. 3, the upper warm air unit 140 is provided on the sheet feeding direction upstream side of the pickup roller 40 and at the rear of the sheet feeding unit 130 in the sheet feeding direction. As noted above, the warm air blowing port 145 is provided on the sheet feeding direction downstream side of the upper warm air unit 140, and therefore warm air can be blown through the warm air blowing port 145 favorably toward the upper face of the sheet stack S accommodated in the sheet accommodating portion 35.

By disposing the upper warm air unit 140 exhibiting high sheet loosening efficiency through effective use of the available space in the sheet feeding unit 130, it is possible to realize a sheet loosening mechanism employing warm air assistance that can be applied to a small sheet feeding device.

More specifically, a constitution in which the sheet stack S carried on the lift plate 31 is raised and lowered using a cantilever elevator mechanism, as in the sheet feeding unit 130 according to this embodiment, is often used in comparatively small sheet feeding devices. When this cantilever elevator mechanism is applied, the sheet feeding direction downstream side on which the pickup roller 40 is provided serves as the side to which the sheet stack S is lifted and the side on which the sheet conveyance mechanism including the pickup roller 40, the sheet feeding roller 41, and so on is provided, and hence little spatial leeway exists. On the other hand, the sheet stack S is not lifted to the sheet feeding direction upstream side, and therefore comparatively large spatial leeway exists on this side. By incorporating the upper warm air unit 140 into this space, as in this embodiment, the outer form of the sheet feeding unit 130 does not have to be enlarged to dispose the upper warm air unit 140, and therefore the constitution described above can be applied favorably to a small sheet feeding device.

Second Embodiment

Figure 11:
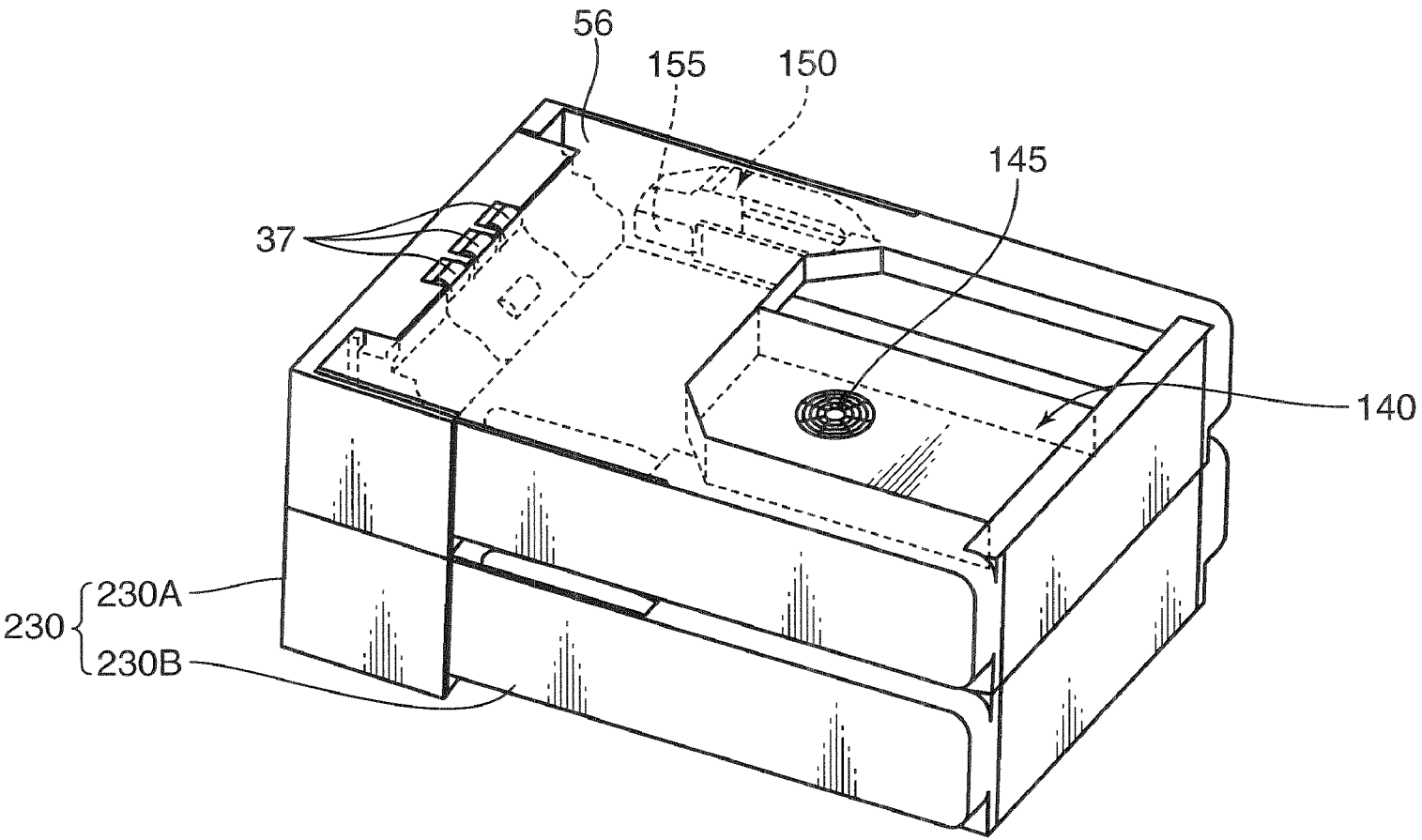
FIG. 11 is a perspective view showing the constitution of a sheet feeding device according to a second embodiment of the present invention.
Figure 12:
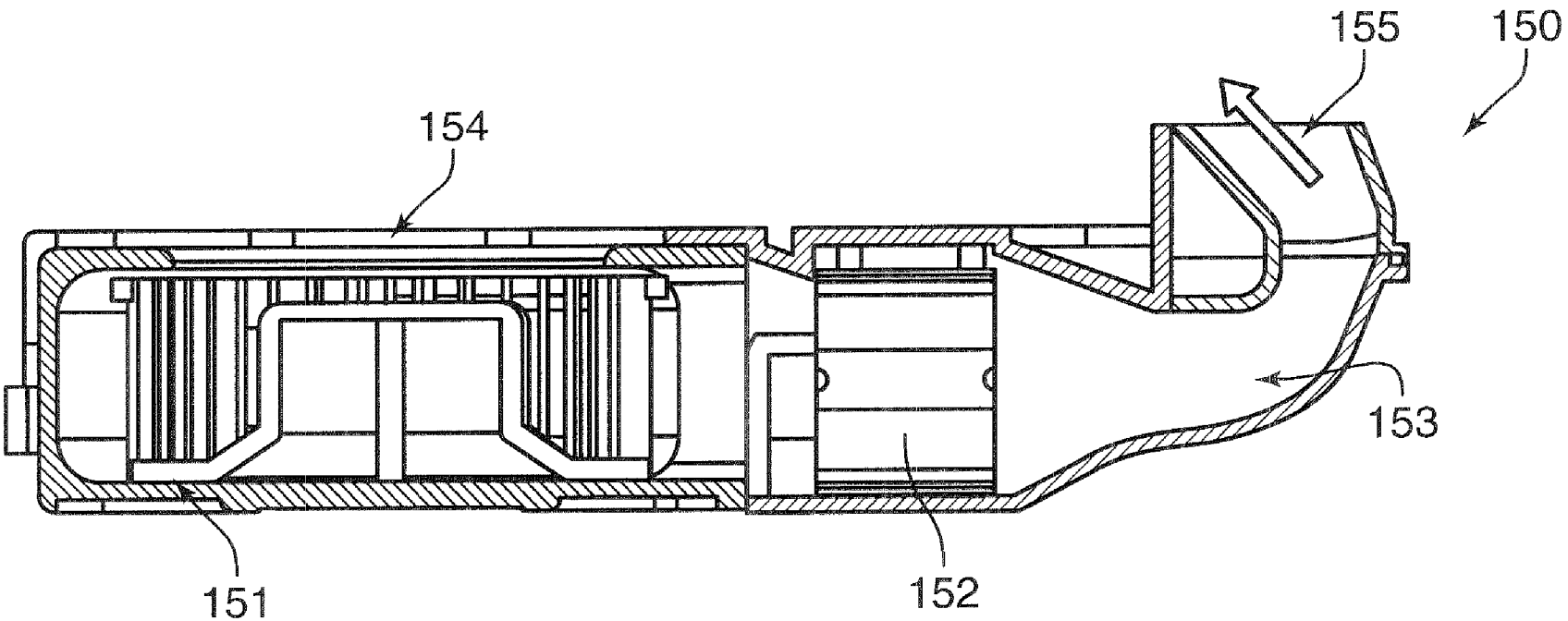
FIG. 12 is a horizontal direction sectional view showing the main parts of a lateral warm air unit installed in the sheet feeding device shown in FIG. 10.
Figure 13:
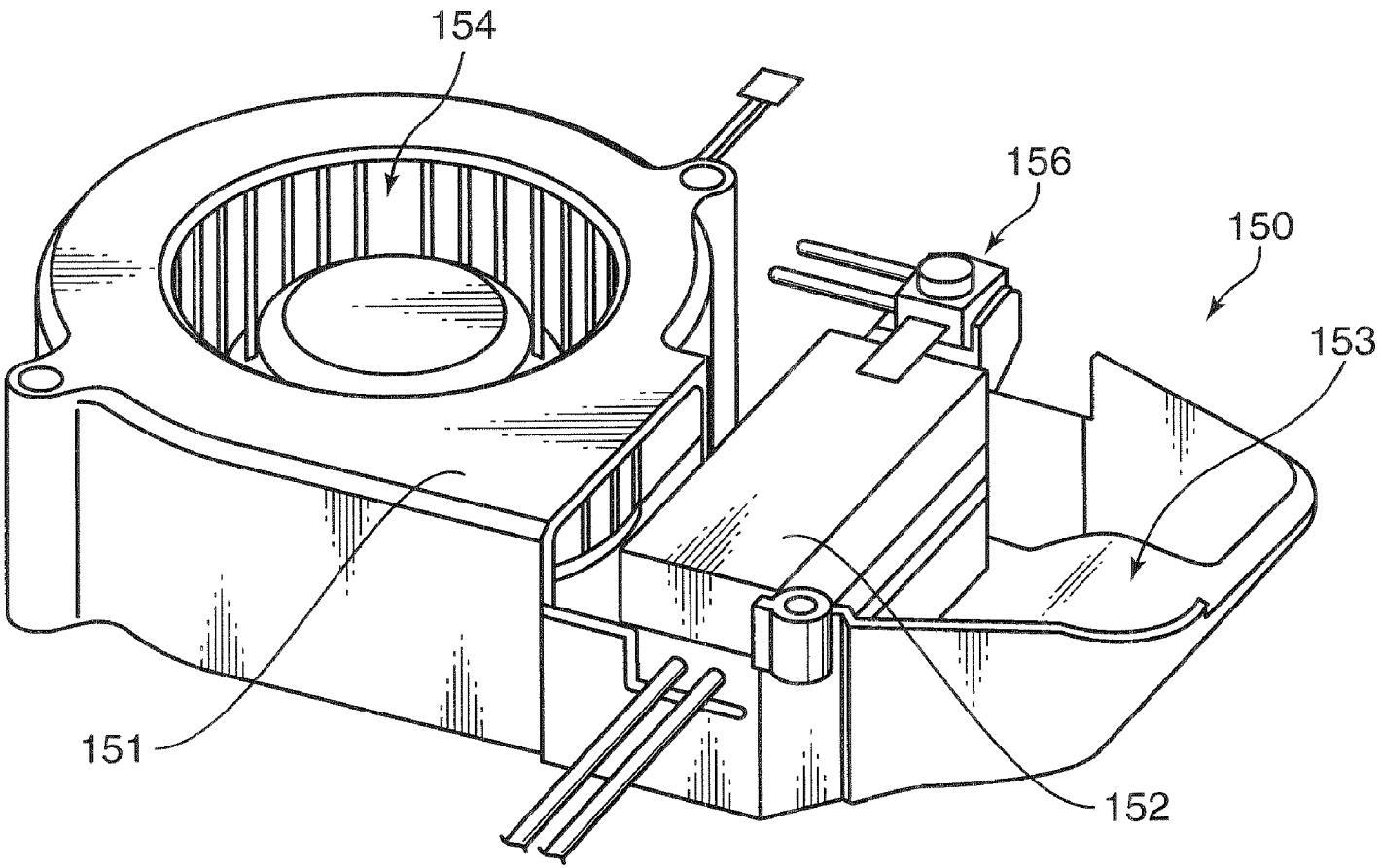
FIG. 13 is a perspective view of the lateral warm air unit.
Figure 14:
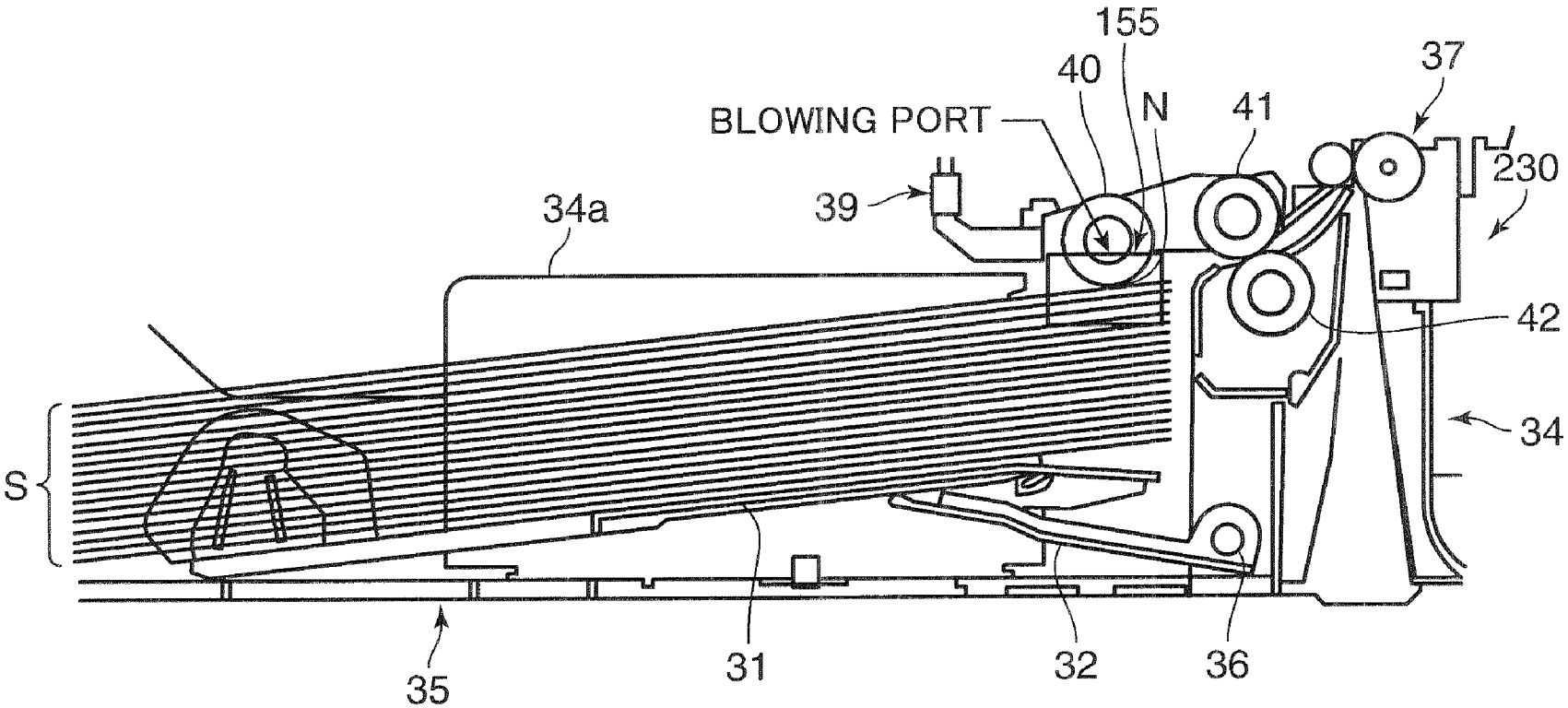
FIG. 14 and FIG. 15 are illustrative views showing a disposal position of a warm air blowing port of the lateral warm air unit.
Figure 15:
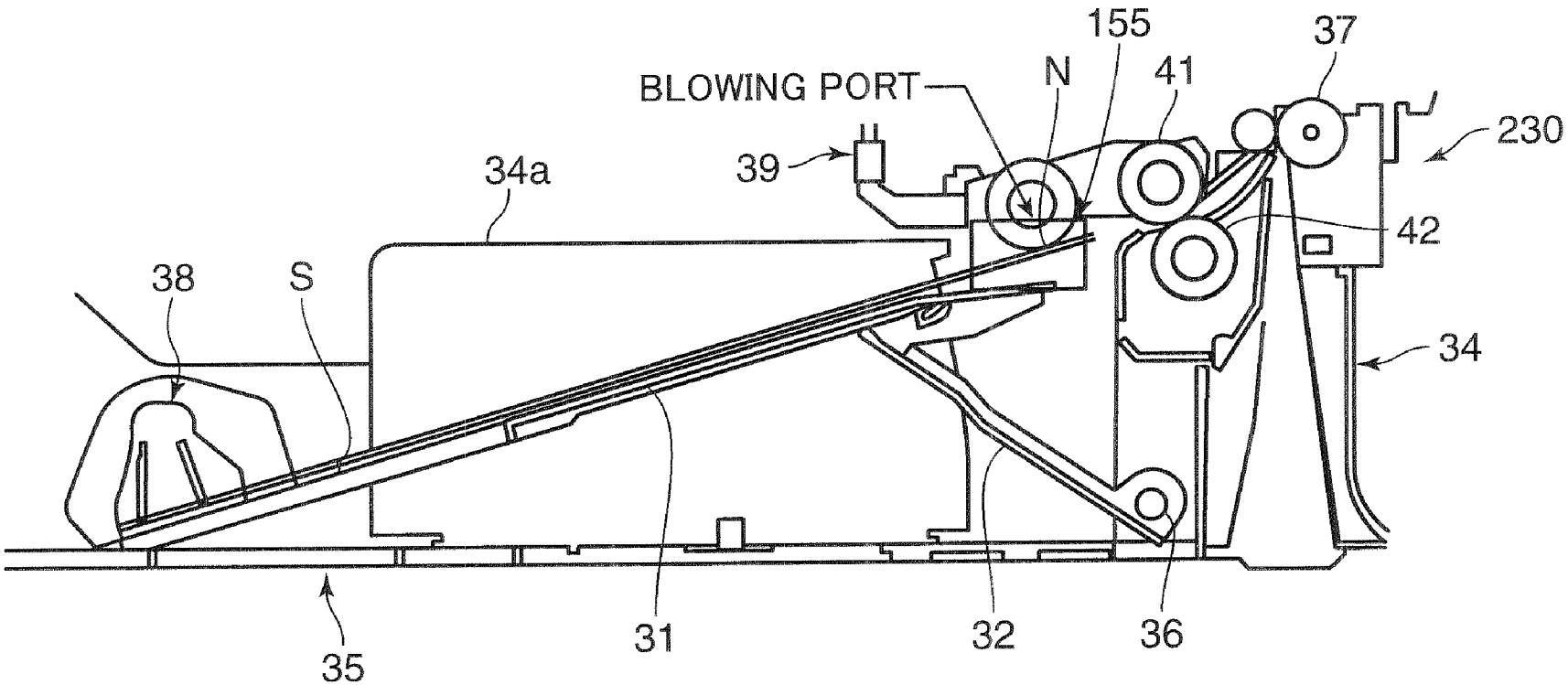
Figure 16:
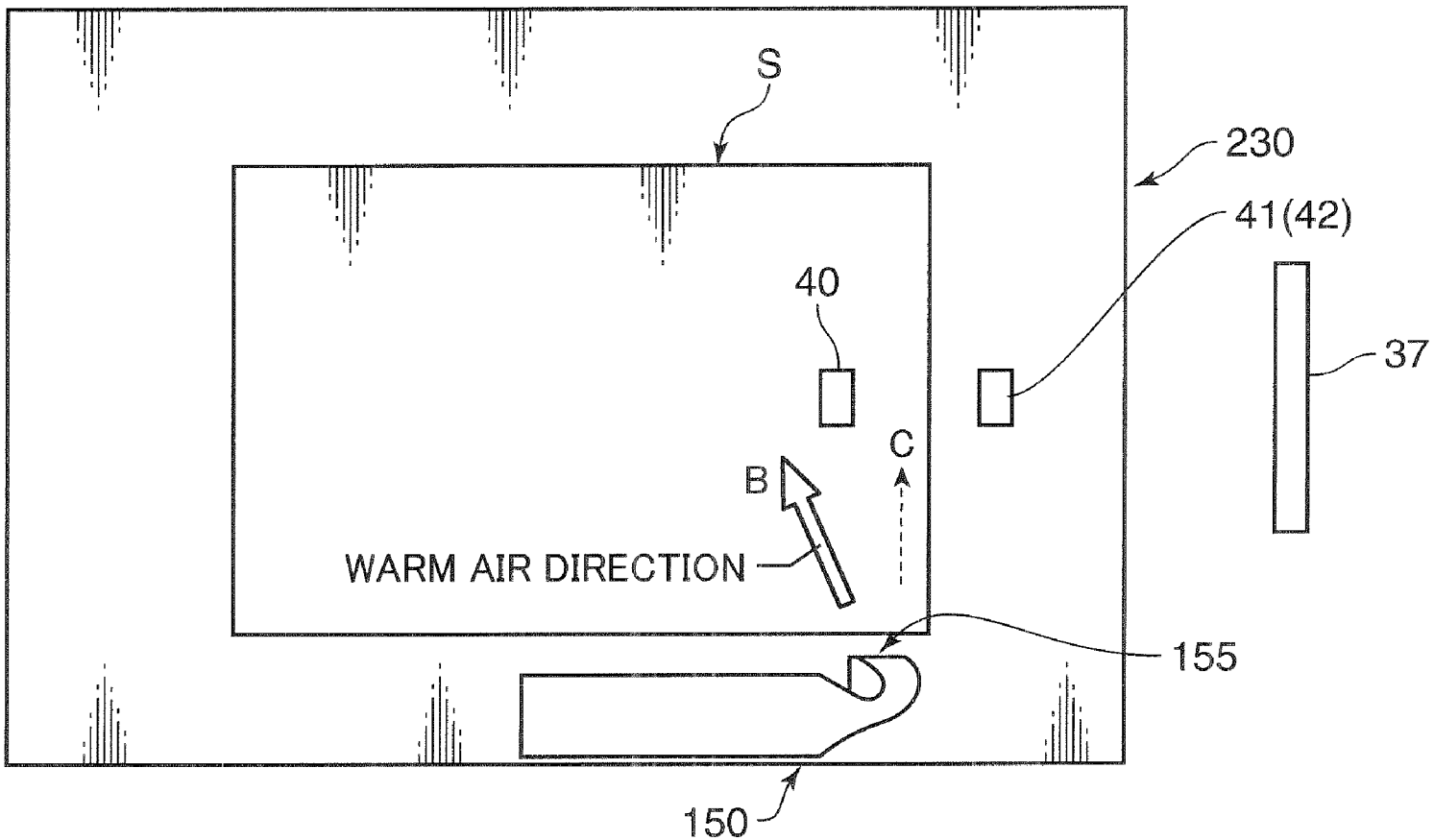
FIG. 16 is an illustrative view showing the warm air blowing direction of the lateral warm air unit.
Figure 17B:
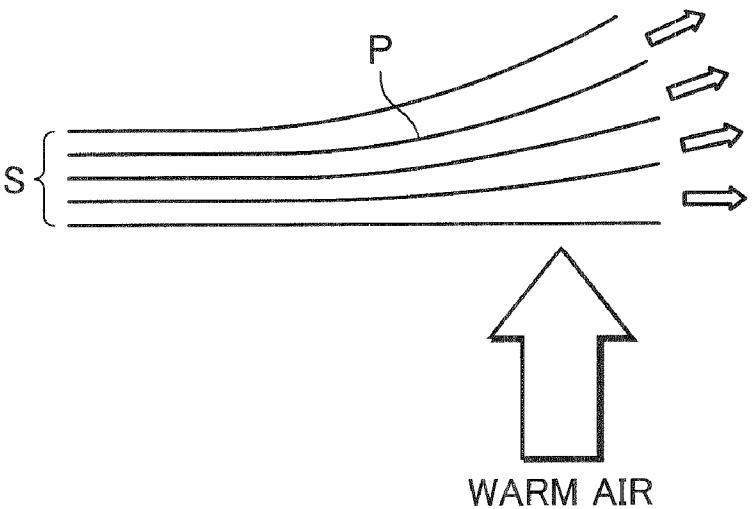
FIGS. 17A and 17B are illustrative views illustrating a warm air blowing condition of the lateral warm air unit.
Figure 17A:
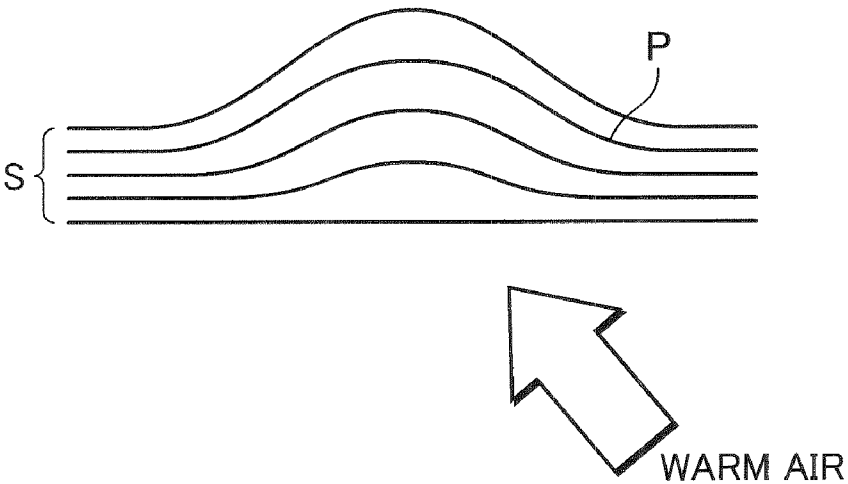
Figure 18:
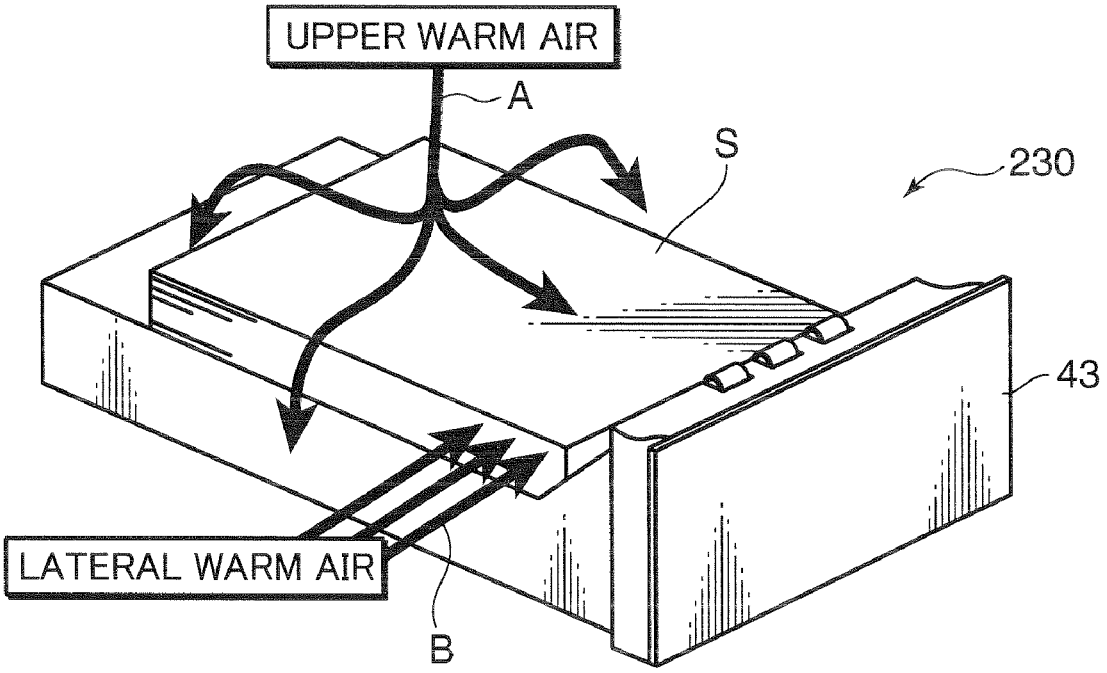
FIG. 18 is a perspective view of a sheet feeding cassette, illustrating lateral warm air and upper warm air blowing directions in the sheet feeding device according to the second embodiment.
Figure 19C:
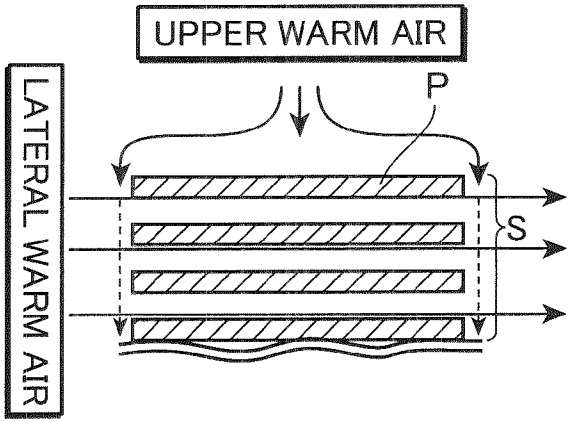
FIGS. 19A, 19B and 19C are illustrative views showing the lateral warm air and upper warm air blowing directions.
Figure 19B:
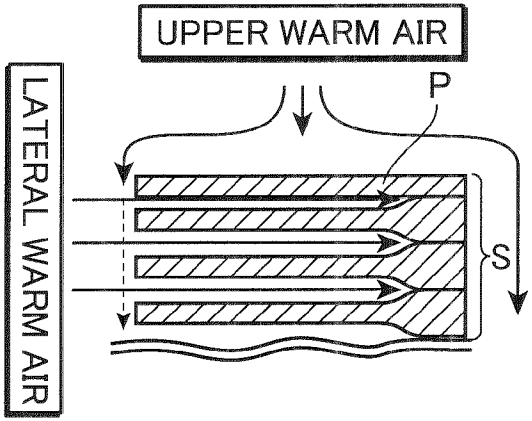
Figure 19A:
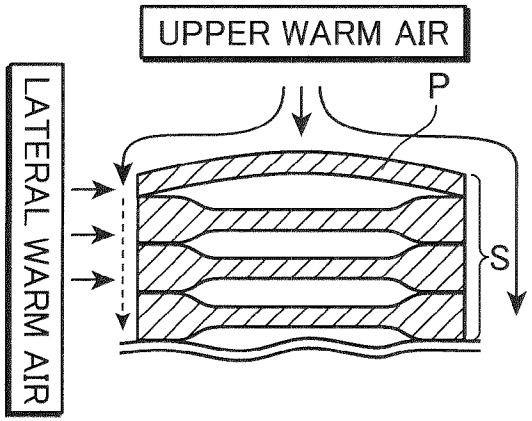

A sheet feeding unit according to a second embodiment of the present invention will be described below with reference to FIGS. 11 to 19C. FIG. 11 is a perspective view showing the constitution of a sheet feeding unit 230 (sheet feeding device) according to the second embodiment. FIG. 12 is a horizontal direction sectional view showing the main parts of a lateral warm air unit 150 (second warm air unit) installed in the sheet feeding unit 230. FIG. 13 is a perspective view of the lateral warm air unit 150. FIGS. 14 and 15 are illustrative views showing formation positions of a warm air blowing port 155 of the lateral warm air unit 150. FIG. 16 is an illustrative view showing a warm air blowing direction of the lateral warm air unit 150. FIGS. 17A and 17B are illustrative views illustrating a warm air blowing state of the lateral warm air unit 150. FIG. 18 is a perspective view of the sheet feeding unit 230, illustrating lateral warm air and upper warm air blowing directions. FIGS. 19A to 19C are illustrative views showing the lateral warm air and upper warm air blowing directions. Note that for ease of description, identical members to the members illustrated in the drawings of the first embodiment have been allocated identical reference symbols, and description thereof has been omitted.

As shown in FIG. 11, the sheet feeding unit 230 according to the second embodiment includes the lateral warm air unit 150 for blowing warm air onto the side face of the sheet stack S in the sheet feeding position as a sheet loosening mechanism employing warm air assistance, in addition to the upper warm air unit 140 of the first embodiment. Other constitutions, such as the constitution of the upper warm air unit 140, are identical to the first embodiment, and therefore description thereof has been omitted.

As shown in FIG. 11, the lateral warm air unit 150 is provided along one side face of a sheet feeding cassette 230A in the sheet feeding direction. As shown in FIG. 12, the lateral warm air unit 150 includes a fan 151 (second blowing portion) and a heater 152 (second heating portion), which are provided in a lateral warm air chamber 153. In contrast to the upper warm air unit 140, the lateral warm air unit 150 aspirates air inside the sheet feeding unit 230 through an intake port 154 provided in the sheet feeding unit 230. When the fan 151 is rotated such that the air in the lateral warm air chamber 153 moves to the heater 152 side, the air in the sheet feeding unit 230 is taken into the lateral warm air chamber 153 through the intake port 154. The air that moves to the heater 152 side is heated by the heater 152 and then blown toward the side face of the sheet stack S through a warm air blowing port 155 (second blowing port).

As shown in FIG. 13, a second temperature sensor 156 (second temperature detection unit) is attached to an upper face of the heater 152. A typical temperature sensor such as a resistance temperature sensor constituted by a thermistor may be used as the second temperature sensor 156.

As shown in FIGS. 14 and 15, on a vertical cross-section of the sheet conveyance direction, the warm air blowing port 155 of the lateral warm air unit 150 for blowing warm air onto the side face of the sheet stack S in the sheet feeding position is oriented toward a point N at which the pickup roller 40 contacts the upper face of the sheet stack S. Thus, warm air can be applied in concentrated fashion to the side face of the sheet stack S in exactly the position in which the pickup roller 40 extracts the uppermost sheet, regardless of the remaining amount of paper, i.e. whether the remaining amount of paper is large, as shown in FIG. 14, or small, as shown in FIG. 15, and as a result, warm air can be blown between the sheets in this part efficiently. Hence, the sheet stack S can be loosened efficiently prior to sheet feeding without increasing the size of the lateral warm air unit 150.

Moreover, the warm air blowing port 155 is oriented such that warm air is blown at an angle on a sheet center direction side relative to the width direction of the sheet stack S (an orthogonal direction to the sheet feeding direction, indicated by an arrow C in FIG. 16), as shown by an arrow B in FIG. 16, rather than directly in (parallel to) the width direction of the sheet. The reason for this is as follows.

When warm air is blown in the direction of the arrow C in FIG. 16, the warm air escapes to the sheet feeding direction downstream side from the side face of the sheet stack S, as shown in FIG. 17B. As a result, the warm air cannot easily penetrate deeply into the sheet stack S, and therefore the loosening efficiency of the lateral warm air decreases. Hence, in the lateral warm air unit 150 according to the second embodiment, the warm air blowing port 155 is formed to blow warm air toward the center side of the fed sheet, as shown by the arrow B in FIG. 16. Thus, as shown in FIG. 17A, the warm air blown from the warm air blowing port 155 can be trapped between the sheets of the sheet stack S. More specifically, when warm air is blown toward the center side of the sheet stack S, the sheet feeding direction upstream side and downstream side of the sheet stack S sag downward due to the weight of the sheets P, thereby forming a lid, and as a result, the warm air is blown deep into the sheet stack S in a wide range without escaping to the outside. Hence, the sheet stack S can be loosened highly efficiently prior to sheet feeding using a constant amount of warm air.

According to the sheet feeding unit 230 of the second embodiment, as shown in FIG. 18, warm air is blown toward the upper face of the sheet stack S (in a direction indicated by an arrow A) by the upper warm air unit 140 and warm air is blown toward the side face of the sheet stack S (in a direction indicated by an arrow B) in exactly the position in which the pickup roller 40 extracts the uppermost sheet by the lateral warm air unit 150. Hence, in comparison with a constitution including only the upper warm air unit 140, the sheet stack S can be loosened more efficiently prior to sheet feeding.

When a predetermined sheet feeding unit 230 is selected during an image formation operation in the constitution described above, the lift plate 31 is driven to rise, whereby the sheet stack S is raised in the direction of the pickup roller 40, and the upper warm air unit 140 is driven to blow warm air toward the upper face of the sheet stack S through the warm air blowing port 145. Moreover, when the position detection sensor 39 detects that the upper face of the sheet stack S has contacted the pickup roller 40, and therefore that the sheet stack S has risen to the sheet feeding position, the lateral warm air unit 150 is driven such that warm air is also blown through the warm air blowing port 155 toward the side face of the sheet stack S in exactly the position in which the pickup roller 40 extracts the uppermost sheet.

FIGS. 19A to 19C show, in schematic form, the degree of efficiency with which the sheet stack S can be loosened by the upper warm air unit 140 and the lateral warm air unit 150. At first, the upper face and side faces of the sheet stack S are swollen due to moisture absorption, causing the pressure on the inside (in the inter-sheet spaces) of the sheet stack S to turn negative such that the sheets stick together. However, when double warm air blowing is applied by the upper warm air unit 140 and the lateral warm air unit 150, as shown in FIG. 19A, the condition of the sheet stack S shifts instantly to a state shown in FIG. 19B.

More specifically, the upper warm air unit 140 is capable of blowing warm air evenly and in concentrated fashion from the upper face of the sheet stack S, in which sticking is particularly likely to occur, to the vicinity of the outer periphery. As a result, the moisture absorption rate of the upper face and outer peripheral part of the sheet stack S is reduced rapidly, thereby eliminating swelling in these parts. The swollen state is eliminated first on the upper face of the sheet stack S, which directly receives the warm air blown from the upper warm air unit 140, and the side face of the sheet stack S on the lateral warm air unit 150 side, which receives warm air from the upper warm air unit 140 and the lateral warm air unit 150 simultaneously, whereby the state shown in FIG. 19B is achieved, and from this state, the condition of the sheet stack S shifts to a state shown in FIG. 19C (in which the sheet stack S is loosened) instantly.

Hence, when warm air is blown by the upper warm air unit 140 and lateral warm air unit 150, the swollen state on the side face of the sheet stack S opposite to the lateral warm air unit 150 is also eliminated instantaneously, and therefore the warm air from the lateral warm air unit 150 passes between the sheets and exits to the exterior of the sheet stack S, thereby loosening the sheet stack S.

Third Embodiment

In the second embodiment, warm air is blown onto the sheet stack S from both the upper warm air unit 140 and the lateral warm air unit 150. In a third embodiment, a control constitution enabling appropriate management of an internal temperature of the sheet feeding unit 230 will be described, taking as a premise the constitution of the sheet feeding unit 230 according to the second embodiment.

Figure 20:
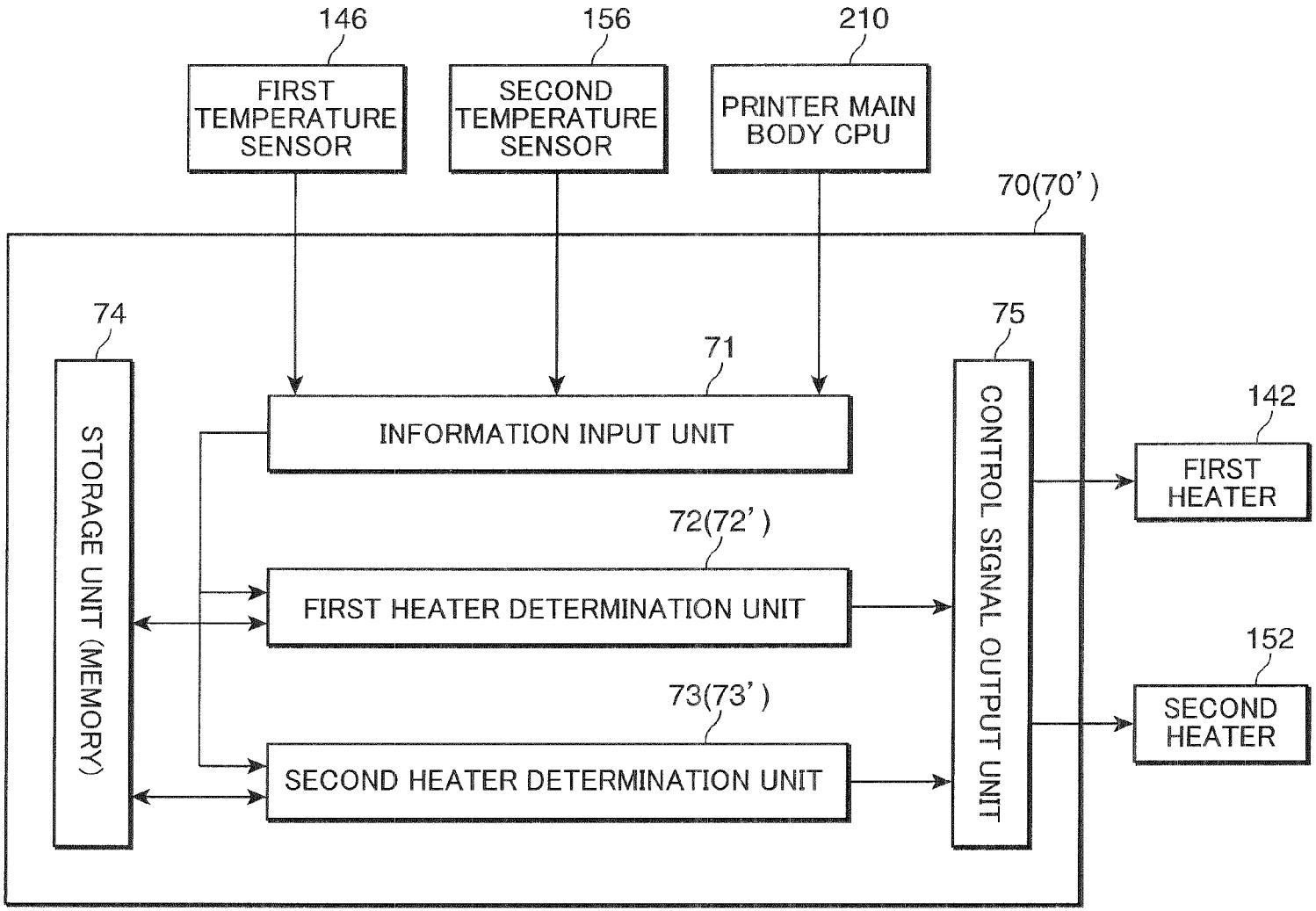
FIG. 20 is a function block diagram showing a temperature control unit applied to third and fourth embodiments of the present invention.
Figure 21:
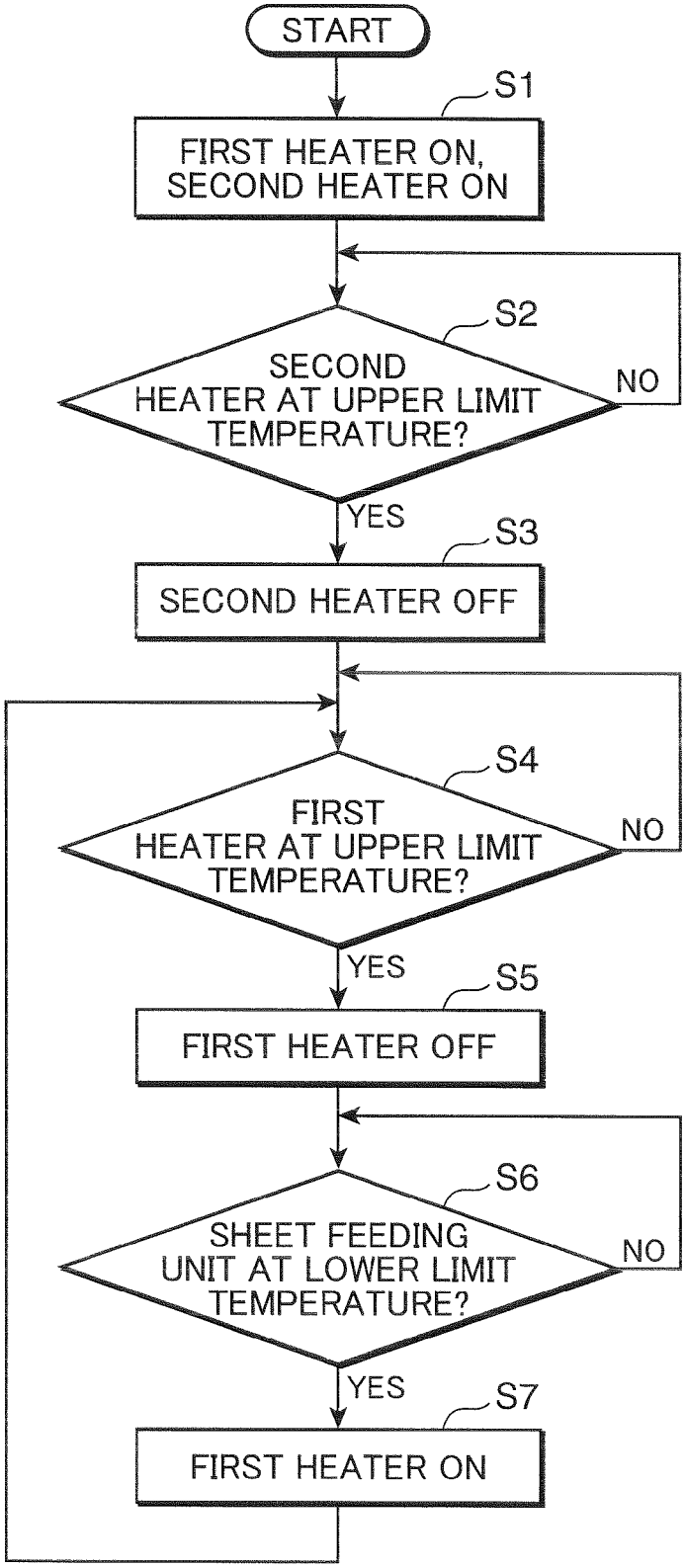
FIG. 21 is a flowchart showing a procedure for controlling an internal temperature of a sheet feeding unit, which is executed by the temperature control unit according to the third embodiment.
Figure 22:
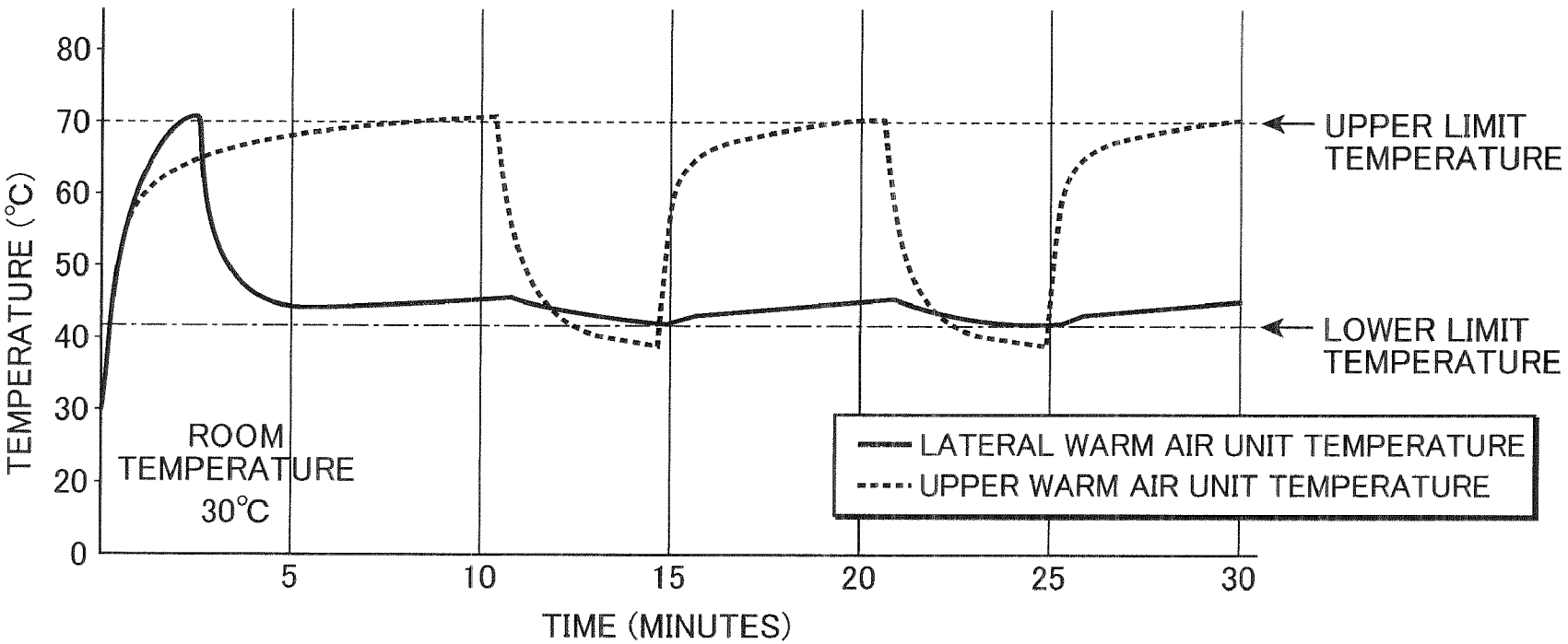
FIG. 22 is a time chart illustrating the temperature control procedure of the third embodiment.

In the color printer 1 according to the third embodiment, a temperature control unit 70 for controlling the internal temperature of the sheet feeding unit 230 is provided. FIG. 20 is a function block diagram showing the functional constitution of the temperature control unit 70. FIG. 21 is a flowchart showing a procedure for controlling the internal temperature of the sheet feeding unit 230 using the temperature control unit 70. FIG. 22 is a time chart illustrating the procedure for controlling the internal temperature of the sheet feeding unit 230. Note that the constitution of the color printer 1 is identical to the constitution described in the first embodiment and the constitution of the sheet feeding unit 230 is identical to the constitution described heretofore in the second embodiment. Description of these constitutions has therefore been omitted.

The temperature control unit 70 controls the internal temperature of the sheet feeding unit 230 by ON-OFF controlling the heater 142 (referred to hereafter as a first heater 142) of the upper warm air unit 140 and the heater 152 (referred to hereafter as a second heater 152) of the lateral warm air unit 150 on the basis of temperature measurement results obtained by the first temperature sensor 146 and second temperature sensor 156. The temperature control unit 70 is constituted by a CPU, a memory (ROM, RAM, and so on), an input interface, and an output interface, for example, and is provided functionally with an information input unit 71, a first heater determination unit 72, a second heater determination unit 73, a storage unit 74, and a control signal output unit 75.

A detection signal from the first temperature sensor 146 for detecting the temperature of the first heater 142 (first heating unit), a detection signal from a second temperature sensor 156 for detecting the temperature of the second heater 152 (second heating unit), a cassette selection signal from a CPU 210 on the printer main body 200 side, a warm air request signal, and so on are input into the information input unit 71. The various signals input into the information input unit 71 are transmitted to the first heater determination unit 72 and the second heater determination unit 73.

The first heater determination unit 72 determines whether or not a detection result obtained by the first temperature sensor 146 of the upper warm air unit 140 is equal to or higher than an upper limit temperature and whether or not the detection result is equal to or lower than a lower limit temperature. The second heater determination unit 73 determines whether or not a detection result obtained by the second temperature sensor 156 of the lateral warm air unit 150 is equal to or higher than an upper limit temperature and whether or not the detection result is equal to or lower than a lower limit temperature.

The storage unit 74 stores thresholds (values of the aforementioned upper limit temperature and lower limit temperature) used by the first heater determination unit 72 and the second heater determination unit 73 in the above determinations, an operating program for performing the determinations, and so on. Here, the upper limit temperatures and lower limit temperatures of the first heater 142 and second heater 152 may be set at identical or different temperatures. Further, the storage unit 74 is provided with a storage area for temporarily storing determination results and other information.

The control signal output unit 75 outputs a control signal (an ON/OFF control signal) corresponding to the determination result of the first heater determination unit 72 to the first heater 142 and outputs a control signal (an ON/OFF control signal) corresponding to the determination result of the second heater determination unit 73 to the second heater 152.

Next, referring to FIGS. 20 to 22, a procedure executed by the temperature control unit 70 according to the third embodiment for controlling the internal temperature of the sheet feeding unit 230 will be described.

When the cassette selection signal and the warm air request signal are input into the information input unit 71 from the CPU 210 on the printer main body 200 side, a sheet feeding preparation period relating to the selected cassette (sheet feeding unit) begins. On the basis of the input signals, the first heater determination unit 72 and second heater determination unit 73 output control signals for switching the first heater 142 and second heater 152 ON to the first heater 142 and second heater 152 via the control signal output unit 75 (step S1). As a result, the first heater 142 of the upper warm air unit 140 and the second heater 152 of the lateral warm air unit 150 begin a heating operation. At the same time, the first fan 141 (first blowing unit) of the upper warm air unit 140 and the second fan 151 (second blowing unit) of the lateral warm air unit 150 begin an operation such that warm air starts to be blown onto the upper face and the side face of the sheet stack S.

Next, the second heater determination unit 73 determines, on the basis of the detection result obtained by the second temperature sensor 156, which is input via the information input unit 71, whether or not the temperature of the second heater 152 is equal to or greater than the upper limit temperature (step S2). In this embodiment, the upper limit temperature of both the first heater 142 and second heater 152 is set at 70° C. When the temperature of the second heater 152 is lower than the upper limit temperature (NO in step S2), the heating performed by the second heater 152 is continued. When the temperature of the second heater 152 equals or exceeds the upper limit temperature (YES in step S2), on the other hand, the second heater determination unit 73 outputs a control signal for switching the second heater 152 OFF to the second heater 152 via the control signal output unit 75 (step S3). Accordingly, the heating performed by the second heater 152 is stopped. At this time, the operation of the second fan 151 of the lateral warm air unit 150 is continued.

Incidentally, the intake port 154 (referred to hereafter as a second intake port 154) of the lateral warm air unit 150 is constituted to take in air from the interior of the sheet feeding unit 230, whereas the intake port 144 (referred to hereafter as a first intake port 144) of the upper warm air unit 140 is constituted to take in air from the exterior of the sheet feeding unit 230. Therefore, as shown in the time chart of FIG. 22, in this embodiment, the second heater 152 of the lateral warm air unit 150 reaches the upper limit temperature (70° C.) before the first heater 142 of the upper warm air unit 140.

As noted above, the second fan 151 continues to operate after the heating performed by the second heater 152 has been stopped in the step S3, and therefore the lateral warm air unit 150 continues to take in air from the interior of the sheet feeding unit 230 through the second intake port 154 and blow the air out through the second blowing port 155. Accordingly, once the surplus heat of the second heater 152 has been extracted, the internal temperature of the lateral warm air unit 150 becomes substantially equal to the internal temperature of the sheet feeding unit 230. Hence, thereafter, the second temperature sensor 156 functions as temperature detecting means for detecting the internal temperature of the sheet feeding unit 230. Thus, the internal temperature of the sheet feeding unit 230 can be managed on the basis of the detection result of the second temperature sensor 156.

Next, the first heater determination unit 72 determines, on the basis of the detection result obtained by the first temperature sensor 146, which is input via the information input unit 71, whether or not the temperature of the first heater 142 is equal to or higher than the upper limit temperature (70° C.) (step S4). When the temperature of the first heater 142 is lower than the upper limit temperature (NO in step S4), the heating performed by the first heater 142 is continued. When the temperature of the first heater 142 equals or exceeds the upper limit temperature (YES in step S4), on the other hand, the first heater determination unit 72 outputs a control signal for switching the first heater 142 OFF to the first heater 142 via the control signal output unit 75 (step S5). Accordingly, the heating performed by the first heater 142 is stopped. At this time, the operation of the first fan 141 of the upper warm air unit 140 is continued.

In this state, neither the first heater 142 nor the second heater 152 is activated, and therefore the internal temperature of the sheet feeding unit 230 gradually decreases. The second heater determination unit 73 then determines whether or not the internal temperature of the sheet feeding unit 230 is equal to or lower than the lower limit temperature on the basis of the detection result obtained by the second temperature sensor 156, which is input via the information input unit 71 (step S6). When the internal temperature of the sheet feeding unit 230 is higher than the lower limit temperature (NO in step S6), the first heater 142 is held in the OFF state. When the internal temperature of the sheet feeding unit 230 is equal to or lower than the lower limit temperature (YES in step S6), on the other hand, the second heater determination unit 73 outputs a control signal for switching the first heater 142 ON to the first heater 142 via the control signal output unit 75 (step S7).

In this embodiment, the first intake port 144 of the upper warm air unit 140 is constituted to take in air from the exterior of the sheet feeding unit 230. However, as long as the second intake port 154 of the lateral warm air unit 150 is constituted to take in air from the interior of the sheet feeding unit 230, the first intake port 144 of the upper warm air unit 140 may be constituted to take in air from either the exterior of the sheet feeding unit 230 or the interior of the sheet feeding unit 230.

As described above, the sheet feeding unit 230 according to the third embodiment includes the second fan 151 for blowing air taken into the lateral warm air chamber 153 from the interior of the sheet feeding unit 230 through the second intake port 154 onto the side face of the sheet stack S that is parallel to the sheet feeding direction through the second blowing port 155, the second heater 152 for heating the air taken into the lateral warm air chamber 153 through the second intake port 154, the second temperature sensor 156 for detecting the temperature of the second heater 152, the first fan 141 for blowing air taken in from the exterior of the sheet feeding unit 230 through the first intake port 144 toward the upper face of the sheet stack S through the first blowing port 145, the first heater 142 for heating the air taken into the upper warm air chamber 143 through the first intake port 144, and the temperature control unit 70 for controlling the internal temperature of the sheet feeding unit 230. The temperature control unit 70 activates both the first heater 142 and the second heater 152 from the start of the sheet feeding preparation period, halts activation of the second heater 152 when the detection result obtained by the second temperature sensor 156 reaches the upper limit temperature, and controls the internal temperature of the sheet feeding unit 230 taking the detection result obtained by the second temperature sensor 156 as the internal temperature of the sheet feeding unit 230 after activation of the second heater 152 has been halted.

According to the above constitution, the temperature control unit 70 executes control such that both the first heater 142 and the second heater 152 are activated from the start of the sheet feeding preparation period. Hence, during the sheet feeding preparation period, the moisture absorption rate of the sheet stack S can be reduced rapidly by raising the internal temperature of the sheet feeding 230 instantaneously, whereby the sheet stack can be loosened easily prior to sheet feeding.

When the second temperature sensor 156 determines that the internal temperature of the lateral warm air unit 150 has reached the upper limit temperature (70° C. in this embodiment), the temperature control unit 70 halts activation of the second heater 152. When activation of the second heater 152 has been halted, the temperature of the second heater 152 in the lateral warm air unit 150 that takes in air from the interior of the sheet feeding unit 230 through the second intake port 154 decreases gradually and eventually becomes substantially equal to the internal temperature of the sheet feeding unit 230. Hence, thereafter, the second temperature sensor 156 functions as temperature detecting means for detecting the internal temperature of the sheet feeding unit 230. Thus, the internal temperature of the sheet feeding unit 230 can be managed on the basis of the detection result obtained by the second temperature sensor 156.

Meanwhile, the first heater 142 of the upper warm air unit 140 continues to operate after activation of the second heater 152 has been halted until the first temperature sensor 146 determines that the temperature of the first heater 142 has reached the upper limit temperature. When the first temperature sensor 146 determines that the temperature of the first heater 142 has reached the upper limit temperature, the temperature control unit 70 executes control to halt activation of the first heater 142.

When the second temperature sensor 156, which now detects the internal temperature of the sheet feeding unit 230, subsequently determines that the internal temperature of the sheet feeding unit 230 (the temperature of the second heater 152) has fallen to the lower limit temperature (40° C. in this embodiment), the temperature control unit 70 executes control to reactivate the first heater 142.

By providing this temperature control mechanism, the internal temperature of the sheet feeding unit 230 can be held at a suitable temperature for reducing the moisture absorption rate of the sheet stack S. Hence, the sheets can be loosened efficiently prior to sheet feeding, whereby problems such as multi-feeding can be prevented even more reliably.

Fourth Embodiment

Figure 23:
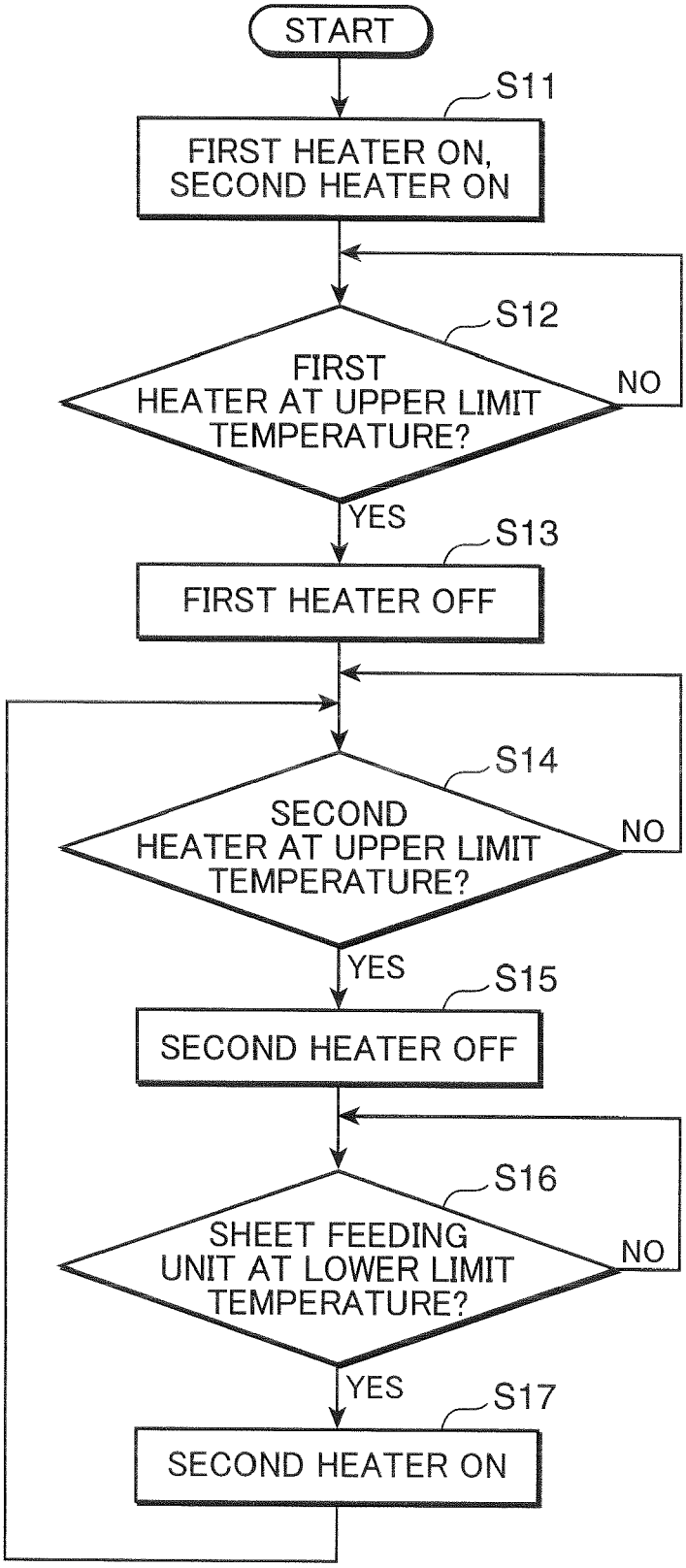
FIG. 23 is a flowchart showing a procedure for controlling an internal temperature of a sheet feeding unit, which is executed by the temperature control unit according to the fourth embodiment.
Figure 24:
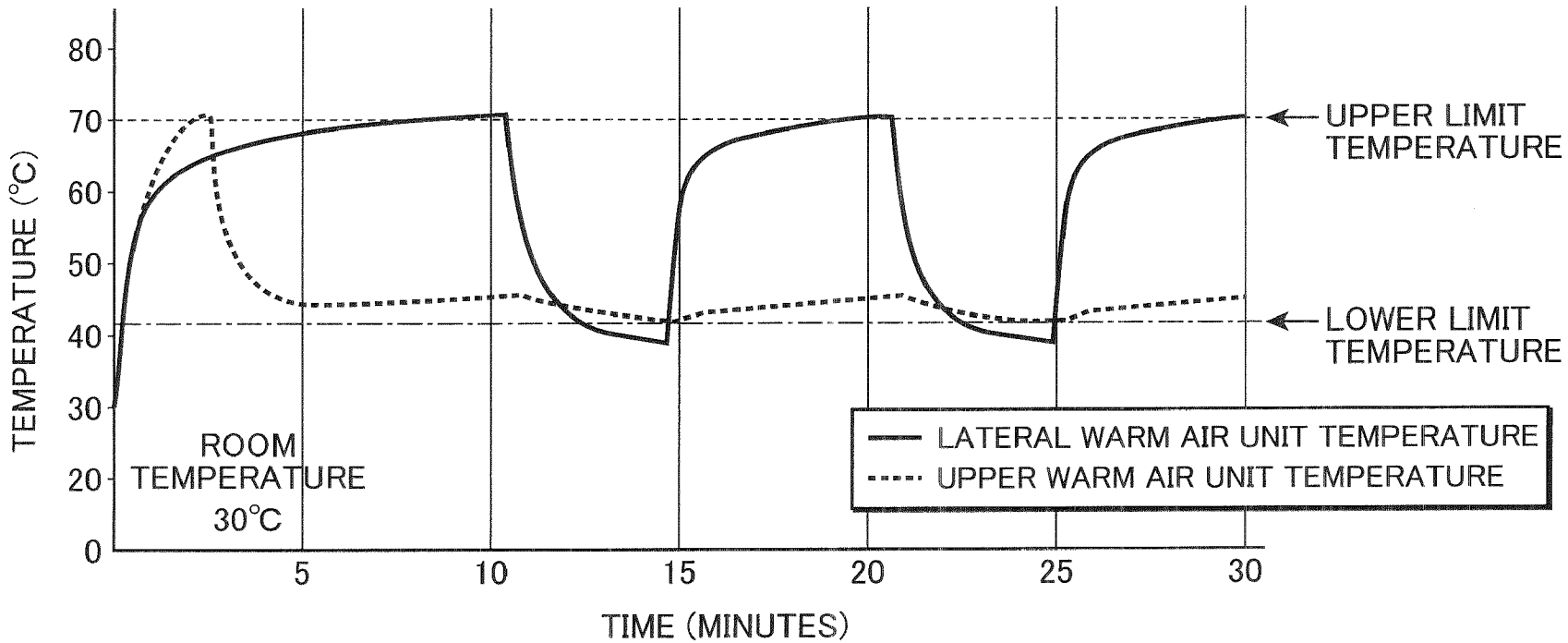
FIG. 24 is a time chart illustrating the temperature control procedure of the fourth embodiment.

Next, a sheet feeding unit according to a fourth embodiment will be described with reference to FIGS. 20, 23 and 24. FIG. 23 is a flowchart showing a procedure for controlling the internal temperature of the sheet feeding unit 230 using a temperature control unit 70' according to the fourth embodiment, and FIG. 24 is a time chart illustrating the temperature control procedure. Note that for ease of description, identical members to the members illustrated in the drawings of the third embodiment have been allocated identical reference symbols, and description thereof has been omitted.

The fourth embodiment differs from the third embodiment in that the internal temperature of the sheet feeding unit 230 is managed on the basis of the detection result of the first temperature sensor 146. Accordingly, in the fourth embodiment, the first intake port 144 of the upper warm air unit 140 shown in FIGS. 9 and 10 is constituted to take in air from the interior of the sheet feeding unit 230 while the second intake port 154 of the lateral warm air unit 150 shown in FIGS. 11 and 12 is constituted to take in air from the exterior of the sheet feeding unit 230. All other constitutions of the sheet feeding unit 230 are identical to their counterparts in the third embodiment.

The functional constitution of the temperature control unit 70' is basically identical to that of the third embodiment, but the operations of a first heater determination unit 72' and a second heater determination unit 73' differ from the third embodiment. The reason for this is that in the fourth embodiment, the internal temperature of the sheet feeding unit 230 is managed on the basis of the temperature detection result obtained by the first temperature sensor 146 provided in the upper warm air unit 140.

As shown in FIG. 20, when the cassette selection signal and the warm air request signal are input into the information input unit 71 from the CPU 210 on the printer main body 200 side, the sheet feeding preparation period relating to the selected cassette (sheet feeding unit) begins. On the basis of the cassette selection signal input from the CPU 210, the first heater determination unit 72' and second heater determination unit 73' of the temperature control unit 70' output control signals for switching the first heater 142 and second heater 152 ON to the first heater 142 and second heater 152, respectively, via the control signal output unit 75 (step S11). As a result, the first heater 142 of the upper warm air unit 140 and the second heater 152 of the lateral warm air unit 150 begin a heating operation. At the same time, the first fan 141 of the upper warm air unit 140 and the second fan 151 of the lateral warm air unit 150 begin an operation such that warm air starts to be blown onto the upper face and the side face of the sheet stack S.

Next, the first heater determination unit 72' determines, on the basis of the detection result of the first temperature sensor 146, which is input via the information input unit 71, whether or not the temperature of the first heater 142 is equal to or higher than the upper limit temperature (step S12). In this embodiment, similarly to the third embodiment, the upper limit temperatures of the first heater 142 and second heater 152 are both set at 70° C. When the temperature of the first heater 142 is lower than the upper limit temperature (NO in step S12), the heating performed by the first heater 142 is continued. When the temperature of the first heater 142 is equal to or higher than the upper limit temperature (YES in step S12), on the other hand, the first heater determination unit 72' outputs a control signal for switching the first heater 142 OFF to the first heater 142 via the control signal output unit 75 (step S13). As a result, the heating performed by the first heater 142 is stopped. At this time, the operation of the first fan 141 is continued.

As described above, in this embodiment, the second intake port 154 of the lateral warm air unit 150 is constituted to take in air from the exterior of the sheet feeding unit 230 whereas the first intake port 144 of the upper warm air unit 140 is constituted to take in air from the interior of the sheet feeding unit 230. Therefore, in the fourth embodiment, as shown in the time chart of FIG. 24, the first heater 142 of the upper warm air unit 140 reaches the upper limit temperature (70° C.) before the second heater 152 of the lateral warm air unit 150.

As described above, the first fan 141 continues to operate even after the heating performed by the first heater 142 has been stopped in the step S13, and therefore the upper warm air unit 140 continues to take in air from the interior of the sheet feeding unit 230 through the first intake port 144 and blow the air out through the first blowing port 145. Accordingly, once the surplus heat of the first heater 142 has been extracted, the internal temperature of the upper warm air unit 140 becomes substantially equal to the internal temperature of the sheet feeding unit 230. Hence, thereafter, the first temperature sensor 146 functions as temperature detecting means for detecting the internal temperature of the sheet feeding unit 230. Thus, the internal temperature of the sheet feeding unit 230 can be managed on the basis of the detection result of the first temperature sensor 146.

Next, the second heater determination unit 73' determines, on the basis of the detection result obtained by the second temperature sensor 156, which is input via the information input unit 71, whether or not the temperature of the second heater 152 is equal to or higher than the upper limit temperature (70° C.) (step S14). When the temperature of the second heater 152 is lower than the upper limit temperature (NO in step S14), the heating performed by the second heater 152 is continued. When the temperature of the second heater 152 equals or exceeds the upper limit temperature (YES in step S14), on the other hand, the second heater determination unit 73' outputs a control signal for switching the second heater 152 OFF to the second heater 152 via the control signal output unit 75 (step S15). Accordingly, the heating performed by the second heater 152 is stopped. At this time, the operation of the second fan 151 of the lateral warm air unit 150 is continued.

In this state, neither the first heater 142 nor the second heater 152 is operative, and therefore the internal temperature of the sheet feeding unit 230 gradually decreases. The first heater determination unit 72' then determines whether or not the internal temperature of the sheet feeding unit 230 is equal to or lower than the lower limit temperature on the basis of the detection result obtained by the first temperature sensor 146, which is input via the information input unit 71 (step S16). When the internal temperature of the sheet feeding unit 230 is higher than the lower limit temperature (NO in step S16), the second heater 152 is held in the OFF state. When the internal temperature of the sheet feeding unit 230 is equal to or lower than the lower limit temperature (YES in step S16), on the other hand, the first heater determination unit 72' outputs a control signal for switching the second heater 152 ON to the second heater 152 via the control signal output unit 75 (step S17).

The sheet feeding unit 230 according to the fourth embodiment includes the temperature control unit 70' for controlling the internal temperature of the sheet feeding unit 230. The temperature control unit 70' activates both the first heater 142 and the second heater 152 from the start of the sheet feeding preparation period, halts activation of the first heater 142 when the detection result obtained by the first temperature sensor 146 reaches the upper limit temperature, and controls the internal temperature of the sheet feeding unit 230 taking the detection result obtained by the first temperature sensor 146 as the internal temperature of the sheet feeding unit 230 after activation of the first heater 142 has been halted.

According to the above constitution, the temperature control unit 70' activates both the first heater 142 and the second heater 152 from the start of the sheet feeding preparation period, and therefore, by raising the internal temperature of the sheet feeding 230 instantaneously during the sheet feeding preparation period, the moisture absorption rate of the sheet stack S can be reduced rapidly, whereby the sheet stack can be loosened easily prior to sheet feeding.

When the first temperature sensor 146 determines that the internal temperature of the upper warm air unit 140 has reached the upper limit temperature (70° C. in this embodiment), the temperature control unit 70' halts activation of the first heater 142. When activation of the first heater 142 has been halted, the temperature of the first heater 142 in the upper warm air unit 140 that takes in air from the interior of the sheet feeding unit 230 through the first intake port 144 decreases to become substantially equal to the internal temperature of the sheet feeding unit 230. Hence, thereafter, the first temperature sensor 146 functions as temperature detecting means for detecting the internal temperature of the sheet feeding unit 230. Thus, the internal temperature of the sheet feeding unit 230 can be managed on the basis of the detection result obtained by the first temperature sensor 146.

Meanwhile, the second heater 152 continues to operate even after activation of the first heater 142 has been halted until the second temperature sensor 156 determines that the temperature of the second heater 152 has reached the upper limit temperature. When the second temperature sensor 156 determines that the temperature of the second heater 152 has reached the upper limit temperature, the temperature control unit 70' executes control to halt activation of the second heater 152.

When the first temperature sensor 146, which now detects the internal temperature of the sheet feeding unit 230, subsequently determines that the internal temperature of the sheet feeding unit 230 (the temperature of the first heater 142) has fallen to the lower limit temperature (40° C. in this embodiment), the temperature control unit 70' executes control to reactivate the second heater 152.

By providing a temperature control mechanism for controlling the internal temperature of the sheet feeding unit 230 in the manner described above, the internal temperature of the sheet feeding unit 230 can be held at a suitable temperature for reducing the moisture absorption rate of the sheet stack S, similarly to the third embodiment. Hence, the sheets can be loosened efficiently prior to sheet feeding, whereby problems such as multi-feeding can be prevented even more reliably.

In the fourth embodiment, similarly to the third embodiment, the respective upper limit temperatures and lower limit temperatures of the first heater 142 and second heater 152 are set at identical temperatures. However, the respective temperatures may be set differently where appropriate such that the upper limit temperature of the first heater 142, which is activated from the start of the sheet feeding preparation period until it reaches the upper limit temperature and maintained in an OFF state after reaching the upper limit temperature, is set to be higher than the upper limit temperature of the second heater 152, for example.

In the fourth embodiment, the second intake port 154 of the lateral warm air unit 150 is constituted to take in air from the exterior of the sheet feeding unit 230. However, as long as the first intake port 144 of the upper warm air unit 140 is constituted to take in air from the interior of the sheet feeding unit 230, the second intake port 154 may be constituted to take in air from either the exterior of the sheet feeding unit 230 or the interior of the sheet feeding unit 230.

Note that in each of the embodiments described above, the first and second heaters 142, 152 and the first and second fans 141, 151 are described as being formed integrally with the upper warm air unit 140 and the lateral warm air unit 150, respectively. However, these members do not necessarily have to be formed integrally, and a constitution in which one of the heater and the fan is provided on the sheet feeding cassette 230A side and the other is provided on the sheet feeding unit main body 230B side, for example, may be employed.

The sheet feeding device according to the present invention may be applied to all types of image forming apparatuses, such as printers, copiers, facsimiles, and compound machines including the functions thereof in composite, and may be used particularly favorably in a small image forming apparatus.

Note that the specific embodiments described above mainly include inventions having the following constitutions.

A sheet feeding device according to one aspect of the present invention is a sheet feeding device for feeding a sheet-form recording medium, comprising:

a sheet accommodating portion for accommodating a sheet stack constituted by a plurality of sheets of the sheet-form recording medium; and a first warm air unit having a first blowing port for blowing warm air toward an upper face of the sheet stack accommodated in the sheet accommodating portion.

According to the above constitution, the first warm air unit for blowing warm air toward the upper face of the sheet stack is provided as a sheet loosening mechanism employing warm air (warm air assistance). The warm air flows over an outer periphery of the sheet stack. The upper face and side faces of the sheet stack swell due to moisture absorption and are therefore likely to stick together, making loosening difficult, but with the constitution described above, warm air can be blown onto the upper face and the vicinity of the outer periphery of the sheet stack in concentrated fashion, and therefore a moisture absorption rate of the upper face and outer peripheral part of the sheet stack can be reduced rapidly, thereby eliminating the swelling in these parts such that negative pressure on the inside of the sheet stack (the spaces between the sheets of the sheet-form recording medium) can also be eliminated. Thus, a reduction in the sticking force of the sheet-form recording medium accommodated in the sheet accommodating portion can be achieved, and as a result, the sheet stack can be loosened efficiently prior to sheet feeding.

Furthermore, the first warm air unit blows the warm air onto the entire upper face and the vicinity of the outer periphery of the sheet stack, i.e. the parts that swell due to moisture absorption, in concentrated fashion, and therefore a sheet loosening efficiency is higher than that achieved with conventional large-scale lateral warm air assistance. As a result, the size of the sheet feeding device can be reduced.

In the above constitution, the first blowing port is preferably provided above the sheet stack opposite the upper face of the sheet stack. According to this constitution, the warm air can be blown accurately toward the upper face of the sheet stack.

The above constitution may further include: a sheet carrying plate for carrying the sheet-form recording medium, a sheet feeding direction upstream side end of which is supported within the sheet accommodating portion to be free to rotate; and an elevator mechanism for raising and lowering a sheet feeding direction downstream side end of the sheet carrying plate such that the sheet carrying plate is displaced between a first position in which the sheet-form recording medium can be fed and a second position withdrawn from the first position.

The cantilever elevator mechanism described above (a mechanism that uses an elevator mechanism to raise and lower the sheet carrying plate, the sheet feeding direction upstream side end of which is supported to be free to rotate) is often used in small sheet feeding devices. As described above, the warm air loosening mechanism employing the first warm air unit exhibits high sheet loosening efficiency, and therefore the sheet-form recording medium accommodated in the sheet accommodating portion can be loosened efficiently prior to sheet feeding even with a small amount of warm air. Hence, by incorporating the first warm air unit into a small sheet feeding device having a cantilever elevator mechanism, a sufficient sheet loosening effect for a small sheet feeding device can be exhibited.

In this case, a pickup roller that contacts the upper face of the sheet stack when the sheet carrying plate is in the first position and dispatches an uppermost sheet of the sheet-form recording medium constituting the sheet stack is preferably further provided, and the first warm air unit is preferably disposed on a sheet feeding direction upstream side of the pickup roller.

According to this constitution, the first warm air unit is provided on the sheet feeding direction upstream side of the pickup roller. By disposing the first warm air unit, which exhibits high sheet loosening efficiency, using available space within the sheet feeding device, it is possible to realize a sheet loosening mechanism employing warm air assistance that can be applied to a small sheet feeding device.

More specifically, when a cantilever elevator mechanism is used, the sheet feeding direction downstream side on which the pickup roller is provided serves as the side to which the sheet stack is lifted and the side on which the pickup roller and so on is provided, and hence little spatial leeway exists. On the other hand, the sheet stack is not lifted to the sheet feeding direction upstream side, and therefore comparatively large spatial leeway exists on this side. By incorporating the first warm air unit into this space, the outer form of the apparatus does not have to be enlarged to dispose the first warm air unit, and therefore the size of the sheet feeding device can be reduced.

The above constitution preferably further includes a second warm air unit having a second blowing port for blowing warm air onto a side face of the sheet stack that is parallel to a sheet feeding direction.

According to this constitution, the second warm air unit for blowing warm air onto the side face of the sheet stack constituted by a plurality of sheets of the sheet-form recording medium is also included as a sheet loosening mechanism employing warm air in addition to the first warm air unit exhibiting high sheet loosening efficiency, and therefore an even greater sheet loosening effect is obtained.

The above constitution preferably further includes: a second warm air unit having a second blowing port for blowing warm air onto a side face of the sheet stack that is parallel to a sheet feeding direction when the sheet stack is supported by the sheet carrying plate in the first position; and a height detection mechanism for detecting contact between the upper face of the sheet stack and the pickup roller, wherein the second blowing port is oriented toward a point at which the pickup roller contacts the upper face of the sheet stack on a vertical cross-section corresponding to the sheet feeding direction, and the second warm air unit blows the warm air onto the side face on the basis of a detection result obtained by the height detection mechanism.

According to this constitution, the second warm air unit is operated when the height detection mechanism determines that the upper face of the sheet stack is in the sheet feeding position in contact with the pickup roller. Further, the second blowing port of the second warm air unit is oriented toward the point at which the pickup roller contacts the upper face of the sheet stack on a vertical cross-section corresponding to the sheet feeding direction, and therefore the warm air can be applied in concentrated fashion to the side face of the sheet-form recording medium in exactly the position in which the sheet-form recording medium is extracted by the pickup roller, whereby the warm air can be blown between the sheets in this part efficiently. Hence, the sheet stack can be loosened efficiently prior to sheet feeding without increasing the size of the second warm air unit. As a result, the overall size of a sheet feeding device including a sheet loosening mechanism that employs warm air can be reduced without reducing the sheet loosening effect.

In the above constitution, the pickup roller is preferably disposed to contact an upper face of a sheet feeding direction tip end side of the sheet stack, and the second blowing port is preferably oriented to blow warm air at an angle on a center direction side of the sheet stack relative to an orthogonal direction to the sheet feeding direction.

According to this constitution, the warm air that is blown out through the second blowing port can be trapped between the sheets of the sheet stack. More specifically, when the warm air is blown at an angle on a center side of the sheet relative to an orthogonal direction to the sheet feeding direction, the sheet feeding direction upstream side and downstream side of the sheet stack sag downward due to the weight of the sheets, thereby forming a lid, and as a result, the warm air is blown deep into the sheet stack in a wide range without escaping to the outside. Hence, the sheet stack can be loosened highly efficiently prior to sheet feeding using a constant amount of warm air.

The above constitution preferably further includes a temperature control unit for controlling an internal temperature of the sheet feeding device, wherein the first warm air unit includes a first intake port capable of taking in air, a first blowing unit for taking in air from the first intake port and generating an air flow to be blown out through the first blowing port, and a first heating unit for heating the air taken into the first blowing unit, the second warm air unit includes a second intake port capable of taking in air, a second blowing unit for taking in air from the second intake port and generating an air flow to be blown out through the second blowing port, and a second heating unit for heating the air taken into the second blowing unit, and the temperature control unit controls the internal temperature of the sheet feeding device by controlling operations of the first heating unit and the second heating unit.

According to this constitution, the internal temperature of the sheet feeding device can be managed to a suitable temperature for loosening the sheet stack through operation control of the first heating unit and second heating unit by the temperature control unit.

In this case, a first temperature detection unit for detecting a temperature of the first heating unit may be further included, the first intake port may take in air from the interior of the sheet feeding device, the second intake port may take in air from the interior of the sheet feeding device or the exterior of the sheet feeding device, and the temperature control unit may activate both the first heating unit and the second heating unit from the start of a sheet feeding preparation period, halt activation of the first heating unit when a detection result obtained by the first temperature detection unit reaches a predetermined upper limit temperature, and control the internal temperature of the sheet feeding device taking the detection result obtained by the first temperature detection unit as the internal temperature of the sheet feeding device after activation of the first heating unit has been halted.

According to this constitution, the temperature control unit performs control to activate both the first heating unit and the second heating unit from the start of the sheet feeding preparation period. Hence, a relative humidity of the sheet stack in the sheet feeding device can be reduced instantaneously by raising the internal temperature of the sheet feeding device instantly during the sheet feeding preparation period, and as a result, the sheet stack can be loosened easily prior to sheet feeding.

Further, the temperature control unit halts activation of the first heating unit when the first temperature detection unit detects that the temperature of the first heating unit has reached the upper limit temperature. Here, air from the interior of the sheet feeding device is taken in through the first intake port, and therefore, by halting activation of the first heating unit, the temperature of the first heating unit decreases gradually such that eventually, the temperature of the first heating unit becomes substantially equal to the internal temperature of the sheet feeding device. Hence, from this point onward, the first temperature detection unit functions as temperature detecting means for detecting the internal temperature of the sheet feeding device. Accordingly, the internal temperature of the sheet feeding device can be managed on the basis of the detection result obtained by the first temperature detection unit.

By providing this temperature control mechanism, the internal temperature of the sheet feeding device can be held at a suitable temperature for reducing the moisture absorption rate of the sheet stack. Hence, the sheets can be loosened efficiently prior to sheet feeding, whereby problems such as multi-feeding can be prevented even more reliably.

The above constitution preferably further includes a second temperature detection unit for detecting a temperature of the second heating unit, wherein the temperature control unit halts activation of the second heating unit when a detection result obtained by the second temperature detection unit reaches a predetermined upper limit temperature.

According to this constitution, the second heating unit continues to operate after activation of the first heating unit has been halted until the second temperature detection unit determines that the temperature of the second heating unit has reached the upper limit temperature. When the second temperature detection unit determines that the temperature of the second heating unit has reached the upper limit temperature, the temperature control unit performs control to halt activation of the second heating unit. When the first temperature detection unit, which now detects the internal temperature of the sheet feeding device, subsequently detects that the temperature of the first heating unit (the internal temperature of the sheet feeding device) has fallen to a lower limit temperature, the temperature control unit performs control to reactivate the second heating unit.

By providing this temperature control mechanism for controlling the internal temperature of the sheet feeding device, control for holding the internal temperature of the sheet feeding device at a suitable temperature can be executed easily and accurately. Hence, the sheets can be loosened efficiently prior to sheet feeding, whereby problems such as multi-feeding can be prevented reliably.

Alternatively, a second temperature detection unit for detecting a temperature of the second heating unit may be provided, the first intake port may take in air from the interior of the sheet feeding device or the exterior of the sheet feeding device, the second intake port may take in air from the interior of the sheet feeding device, and the temperature control unit may activate both the first heating unit and the second heating unit from the start of a sheet feeding preparation period, halt activation of the second heating unit when a detection result obtained by the second temperature detection unit reaches a predetermined upper limit temperature, and control the internal temperature of the sheet feeding device taking the detection result obtained by the second temperature detection unit as the internal temperature of the sheet feeding device after activation of the second heating unit has been halted.

According to this constitution, in contrast to the constitution described above, the internal temperature of the sheet feeding device can be managed on the basis of the detection result obtained by the second temperature detection unit, whereby identical advantages are obtained.

In this case, a first temperature detection unit for detecting a temperature of the first heating unit is preferably further provided, and the temperature control unit preferably halts activation of the first heating unit when a detection result obtained by the first temperature detection unit reaches a predetermined upper limit temperature.

An image forming apparatus according to another aspect of the present invention comprises:

a sheet feeding device for feeding a sheet-form recording medium; and an apparatus main body including an image formation unit for forming an image on the sheet-form recording medium fed from the sheet feeding device, wherein the sheet feeding device includes a sheet accommodating portion for accommodating a sheet stack constituted by a plurality of sheets of the sheet-form recording medium, and a first warm air unit having a first blowing port for blowing warm air toward an upper face of the sheet stack accommodated in the sheet accommodating portion.

According to this constitution, a sheet feeding device including the first warm air unit, which exhibits higher sheet loosening efficiency than conventional large-scale lateral warm air assistance, is provided as a sheet loosening mechanism employing warm air. Accordingly, the size of the sheet feeding device can be reduced, and therefore a reduction in the overall size of the image forming apparatus that includes the sheet feeding device having the sheet loosening mechanism employing warm air can be achieved.

The above constitution preferably further includes a second warm air unit having a second blowing port for blowing warm air onto a side face of the sheet stack that is parallel to a sheet feeding direction. According to this constitution, a further improvement in the warm air sheet loosening efficiency can be achieved.

The above constitution preferably further includes a temperature control unit for controlling an internal temperature of the sheet feeding device, wherein the first warm air unit includes a first intake port capable of taking in air, a first blowing unit for taking in air from the first intake port and generating an air flow to be blown out through the first blowing port, and a first heating unit for heating the air taken into the first blowing unit, the second warm air unit includes a second intake port capable of taking in air, a second blowing unit for taking in air from the second intake port and generating an air flow to be blown out through the second blowing port, and a second heating unit for heating the air taken into the second blowing unit, and the temperature control unit controls the internal temperature of the sheet feeding device by controlling operations of the first heating unit and the second heating unit.

According to this constitution, the internal temperature of the sheet feeding device can be managed to a suitable temperature for loosening the sheet stack through operation control of the first heating unit and second heating unit by the temperature control unit.

In this case, a first temperature detection unit for detecting a temperature of the first heating unit may be further provided, the first intake port may take in air from the interior of the sheet feeding device, the second intake port may take in air from the interior of the sheet feeding device or the exterior of the sheet feeding device, and the temperature control unit may activate both the first heating unit and the second heating unit from the start of a sheet feeding preparation period, halt activation of the first heating unit when a detection result obtained by the first temperature detection unit reaches a predetermined upper limit temperature, and control the internal temperature of the sheet feeding device taking the detection result obtained by the first temperature detection unit as the internal temperature of the sheet feeding device after activation of the first heating unit has been halted.

Alternatively, a second temperature detection unit for detecting a temperature of the second heating unit may be further provided, the first intake port may take in air from the interior of the sheet feeding device or the exterior of the sheet feeding device, the second intake port may take in air from the interior of the sheet feeding device, and the temperature control unit may activate both the first heating unit and the second heating unit from the start of a sheet feeding preparation period, halt activation of the second heating unit when a detection result obtained by the second temperature detection unit reaches a predetermined upper limit temperature, and control the internal temperature of the sheet feeding device taking the detection result obtained by the second temperature detection unit as the internal temperature of the sheet feeding device after activation of the second heating unit has been halted.

In the above constitution, the sheet feeding device can preferably be attached below the apparatus main body in a plurality of stacked tiers.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet feeding device for feeding a sheet-form recording medium, comprising:

a sheet feeding unit main body;

a sheet feeding cassette slidably insertable into the sheet feeding unit main body and slidably withdrawable from the sheet feeding unit main body;

a sheet accommodating portion provided in the sheet feeding cassette for accommodating a sheet stack constituted by a plurality of sheets of said sheet-form recording medium, a first heated air unit mounted to the sheet feeding unit main body and disposed above and substantially adjacent to said sheet accommodating portion, said first heated air unit having a first intake port capable of taking in air, a first blowing unit for taking in air from said first intake port and generating an airflow to be blown out through said first blowing port, a first heating unit for heating said air taken into said first blowing unit, a first blowing port for blowing toward an upper face of said sheet stack air that has been heated by said first heating unit accommodated in said sheet accommodating portion, and a housing for housing said first blowing unit and said first heating unit, and formed with said first blowing port and said first intake port.

2. The sheet feeding device according to claim 1, further comprising:

a sheet carrying plate for carrying said sheet-form recording medium, a sheet feeding direction upstream side end of which is supported within said sheet accommodating portion to be free to rotate; and an elevator mechanism for raising and lowering a sheet feeding direction downstream side end of said sheet carrying plate such that said sheet carrying plate is displaced between a first position in which said sheet-form recording medium can be fed and a second position withdrawn from said first position.

3. The sheet feeding device according to claim 2, further comprising a pickup roller that contacts said upper face of said sheet stack when said sheet carrying plate is in said first position and dispatches an uppermost sheet of said sheet-form recording medium constituting said sheet stack, wherein said first heated air unit is disposed on a sheet feeding direction upstream side of said pickup roller.

4. The sheet feeding device according to claim 3, further comprising:

a second heated air unit having a second blowing port for blowing air that has been heated by the second heated air unit onto a side face of said sheet stack that is parallel to a sheet feeding direction when said sheet stack is supported by said sheet carrying plate in said first position; and a height detection mechanism for detecting contact between said upper face of said sheet stack and said pickup roller, wherein said second blowing port is oriented toward a point at which said pickup roller contacts said upper face of said sheet stack on a vertical cross-section corresponding to said sheet feeding direction, and said second heated air unit blows said air that has been heated by the second heated air unit onto said side face on the basis of a detection result obtained by said height detection mechanism.

5. The sheet feeding device according to claim 4, wherein said pickup roller is disposed to contact an upper face of a sheet feeding direction tip end side of said sheet stack, and said second blowing port is oriented to blow air that has been heated by the second heated air unit at an angle on a center direction side of said sheet stack relative to an orthogonal direction to said sheet feeding direction.

6. The sheet feeding device according to claim 1, further comprising a second heated air unit having a second blowing port for blowing air that has been heated by the second heated air unit onto a side face of said sheet stack that is parallel to a sheet feeding direction.

7. The sheet feeding device according to claim 6, further comprising a temperature control unit for controlling an internal temperature of said sheet feeding device, wherein said second heated air unit includes a second intake port capable of taking in air, a second blowing unit for taking in air from said second intake port and generating an air flow to be blown out through said second blowing port, and a second heating unit for heating said air taken into said second blowing unit, and said temperature control unit controls said internal temperature of said sheet feeding device by controlling operations of said first heating unit and said second heating unit.

8. The sheet feeding device according to claim 7, further comprising a first temperature detection unit for detecting a temperature of said first heating unit, wherein said first intake port takes in air from the interior of said sheet feeding device, said second intake port takes in air from the interior of said sheet feeding device or the exterior of said sheet feeding device, and said temperature control unit activates both said first heating unit and said second heating unit from the start of a sheet feeding preparation period, halts activation of said first heating unit when a detection result obtained by said first temperature detection unit reaches a predetermined upper limit temperature, and controls said internal temperature of said sheet feeding device, taking said detection result obtained by said first temperature detection unit as said internal temperature of said sheet feeding device after activation of said first heating unit has been halted.

9. The sheet feeding device according to claim 8, further comprising a second temperature detection unit for detecting a temperature of said second heating unit, wherein said temperature control unit halts activation of said second heating unit when a detection result obtained by said second temperature detection unit reaches a predetermined upper limit temperature.

10. The sheet feeding device according to claim 7, further comprising a second temperature detection unit for detecting a temperature of said second heating unit, wherein said first intake port takes in air from the interior of said sheet feeding device or the exterior of said sheet feeding device, said second intake port takes in air from the interior of said sheet feeding device, and said temperature control unit activates both said first heating unit and said second heating unit from the start of a sheet feeding preparation period, halts activation of said second heating unit when a detection result obtained by said second temperature detection unit reaches a predetermined upper limit temperature, and controls said internal temperature of said sheet feeding device, taking said detection result obtained by said second temperature detection unit as said internal temperature of said sheet feeding device after activation of said second heating unit has been halted.

11. The sheet feeding device according to claim 10, further comprising a first temperature detection unit for detecting a temperature of said first heating unit, wherein said temperature control unit halts activation of said first heating unit when a detection result obtained by said first temperature detection unit reaches a predetermined upper limit temperature.

12. An image forming apparatus comprising:

a sheet feeding device for feeding a sheet-form recording medium; and an apparatus main body including an image formation unit for forming an image on said sheet-form recording medium fed from said sheet feeding device, wherein said sheet feeding device includes:

a sheet feeding unit main body;

a sheet feeding cassette slidably insertable into the sheet feeding unit main body and slidably withdrawable from the sheet feeding unit main body, a sheet accommodating portion provided in the sheet feeding cassette for accommodating a sheet stack constituted by a plurality of sheets of said sheet-form recording medium, a first heated air unit mounted to the sheet feeding unit main body and disposed above substantially adjacent said sheet accommodating portion, said first heated air unit having a first intake port capable of taking in air, a first blowing unit for taking in air from said first intake port and generating an air flow to be blown out through said first blowing port, a first heating unit for heating said air taken into said first blowing unit, a first blowing port for blowing air that has been warmed heated by the first heating unit toward an upper face of said sheet stack accommodated in said sheet accommodating portion, and a housing for housing said first blowing unit and said first heating unit, and formed with said first blowing port and said first intake port.

13. The image forming apparatus according to claim 12, further comprising a second heated air unit having a second blowing port for blowing air that has been heated by the second heated air unit onto a side face of said sheet stack that is parallel to a sheet feeding direction.

14. The image forming apparatus according to claim 13, further comprising a temperature control unit for controlling an internal temperature of said sheet feeding device, wherein said second heated air unit includes a second intake port capable of taking in air, a second blowing unit for taking in air from said second intake port and generating an air flow to be blown out through said second blowing port, and a second heating unit for heating said air taken into said second blowing unit, and said temperature control unit controls said internal temperature of said sheet feeding device by controlling operations of said first heating unit and said second heating unit.

15. The image forming apparatus according to claim 14, further comprising a first temperature detection unit for detecting a temperature of said first heating unit, wherein said first intake port takes in air from the interior of said sheet feeding device, said second intake port takes in air from the interior of said sheet feeding device or the exterior of said sheet feeding device, and said temperature control unit activates both said first heating unit and said second heating unit from the start of a sheet feeding preparation period, halts activation of said first heating unit when a detection result obtained by said first temperature detection unit reaches a predetermined upper limit temperature, and controls said internal temperature of said sheet feeding device, taking said detection result obtained by said first temperature detection unit as said internal temperature of said sheet feeding device after activation of said first heating unit has been halted.

16. The image forming apparatus according to claim 14, further comprising a second temperature detection unit for detecting a temperature of said second heating unit, wherein said first intake port takes in air from the interior of said sheet feeding device or the exterior of said sheet feeding device, said second intake port takes in air from the interior of said sheet feeding device, and said temperature control unit activates both said first heating unit and said second heating unit from the start of a sheet feeding preparation period, halts activation of said second heating unit when a detection result obtained by said second temperature detection unit reaches a predetermined upper limit temperature, and controls said internal temperature of said sheet feeding device, taking said detection result obtained by said second temperature detection unit as said internal temperature of said sheet feeding device after activation of said second heating unit has been halted.

17. The image forming apparatus according to claim 12, wherein said sheet feeding device can be attached below said apparatus main body in a plurality of stacked tiers.

* * * * *